US010910174B2

(12) United States Patent
Morita et al.

(10) Patent No.: US 10,910,174 B2
(45) Date of Patent: Feb. 2, 2021

(54) PUSH-BUTTON SWITCH

(71) Applicant: OMRON Corporation, Kyoto (JP)

(72) Inventors: Kazuaki Morita, Okayama (JP); Yusuke Komoguchi, Okayama (JP); Tadahiko Ogawa, Moriyama (JP); Masami Nishida, Osaka (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 16/644,741

(22) PCT Filed: Nov. 22, 2018

(86) PCT No.: PCT/JP2018/043149
§ 371 (c)(1),
(2) Date: Mar. 5, 2020

(87) PCT Pub. No.: WO2019/130925
PCT Pub. Date: Jul. 4, 2019

(65) Prior Publication Data

US 2020/0266010 A1 Aug. 20, 2020

(30) Foreign Application Priority Data

Dec. 28, 2017 (JP) ..... 2017-254308

(51) Int. Cl.
*H01H 13/14* (2006.01)
*H01H 13/04* (2006.01)
(Continued)

(52) U.S. Cl.
CPC ..... *H01H 13/14* (2013.01); *H01H 13/04* (2013.01); *H01H 13/52* (2013.01); *H01H 13/023* (2013.01);
(Continued)

(58) Field of Classification Search
CPC ..... H01H 13/14; H01H 13/04; H01H 13/52; H01H 13/023; H01H 2221/016;
(Continued)

(56) References Cited

U.S. PATENT DOCUMENTS 6,376,785 B1 * 4/2002 Graninger ..... H01H 13/503 200/329
2005/0205397 A1 * 9/2005 Gibbons ..... H01H 13/20 200/17 R
(Continued)

FOREIGN PATENT DOCUMENTS

CN 206293309 U 6/2017
JP 2003308756 A 10/2003
(Continued)

OTHER PUBLICATIONS

International Application No. PCT/JP2018/043149; International Filing Date Nov. 22, 2018; Written Opinion of the International Searching Authority; Date of Completion of Opinion Feb. 12, 2019; 3 pages.
(Continued)

*Primary Examiner* — Ahmed M Saeed
(74) *Attorney, Agent, or Firm* — Cantor Colburn LLP

(57) ABSTRACT

A push-button switch may include a housing, an operation unit, a lock lever unit, and a biasing portion. A lever support portion may be connected to the operation unit so as to be movable together with the operation unit when a lever body is positioned at a second position. The housing may have a deformation portion that, when the operation unit is pulled in an opening direction when the lever body is positioned at the second position, deforms the lever body so as to be capable of releasing the pressing to the lever body by a holding unit.

4 Claims, 17 Drawing Sheets

(51) Int. Cl.
*H01H 13/52* (2006.01)
*H01H 13/02* (2006.01)

(52) U.S. Cl.
CPC ... *H01H 2221/016* (2013.01); *H01H 2221/08* (2013.01)

(58) Field of Classification Search
CPC ..... H01H 2221/08; H01H 3/20; H01H 13/02; H01H 3/022; H01H 3/12; H01H 11/0012; H01H 13/506; H01H 9/22; H01H 19/6355; H01H 2003/024; H01H 2221/066; H01H 3/001; H01H 13/62; H01H 1/205; H01H 1/2083; H01H 2003/0246
See application file for complete search history.

(56) References Cited

U.S. PATENT DOCUMENTS

2015/0303658 A1 10/2015 Wu et al.
2015/0340178 A1* 11/2015 Shimoyama ..... H01H 13/14 200/4
2016/0196933 A1* 7/2016 Wiese ..... H01H 13/52 200/341
2018/0240625 A1* 8/2018 Stuklek ..... H01C 10/50

FOREIGN PATENT DOCUMENTS

JP 4147049 B2 9/2008
JP 2015204297 A 11/2015
TW M541106 U 5/2017

OTHER PUBLICATIONS

International Search Report; International Application No. PCT/JP2018/043149; dated of ISR Feb. 26, 2019; 2 pages.
Taiwan Intellectual Property Office; Office Action dated Sep. 6, 2019; 7 pages (including English Translation).

* cited by examiner

PUSH-BUTTON SWITCH

CROSS REFERENCE TO RELATED APPLICATIONS

This is the U.S. national stage of application No. PCT/JP2018/043149, filed on Nov. 22, 2018. Priority under 35 U.S.C. § 119(a) and 35 U.S.C. § 365(b) is claimed from Japanese Application No. 2017-254308 filed Dec. 28, 2017, the disclosure of which is also incorporated herein by reference.

TECHNICAL FIELD

The present disclosure relates to push-button switches.

BACKGROUND ART

Patent document 1 discloses an operation switch including a contact portion having a contact B, an operation unit for opening and closing the contact B of the contact portion, and a lock mechanism having a lock lever capable of fixing the operation unit and the contact portion to each other.

The operation switch is configured such that when the lock lever is at an unlock position where the operation unit and the contact portion are not locked by the lock mechanism, the contact B is in an off state, and when the lock lever is at a lock position where the operation unit and the contact portion are locked by the lock mechanism, the contact B is in an on state.

RELATED ART DOCUMENTS

Patent Documents

Patent document 1: Japanese Patent No. 4147049

SUMMARY OF INVENTION

Technical Problem

In the operation switch, for example, in a lock state in which the operation unit and the contact portion are fixed to each other by the lock mechanism, if the operation unit is pulled in a direction away from the contact portion, there is a possibility that the operation unit and the lock lever become inoperable while the contact B remains on-state, and the safety of the switch cannot be ensured.

An object of the present disclosure is to provide a push-button switch capable of easily ensuring safety.

Solution to Problem

A push-button switch according to an example of the present disclosure includes:

a housing having an operation surface provided with an operation hole and a housing portion provided therein and connected to the operation hole;

an operation unit that extends along a movable direction intersecting the operation surface from an outside of the housing through the operation hole to an inside of the housing portion and has a pressing surface provided at the outside of the housing and disposed so as to face the operation surface, the pressing surface being capable of approaching the operation surface along the movable direction;

a lock lever unit that has a lever body provided at an end portion on the operation surface side of the housing and movable in a direction intersecting the movable direction between a first position and a second position, a lever support portion provided in the inside of the housing portion and connected to the lever body so as to be movable together with the lever body, and a holding unit capable of holding the lever body by pressing the lever body at the second position from an approaching direction of the pressing surface to the operation surface, and a biasing portion provided inside the housing portion and biasing the lever body from the second position toward the first position, in which the lever support portion is connected to the operation unit so as to be movable in the movable direction together with the operation unit when the lever body is positioned at the second position, and the housing has a deformation portion that is provided on an inner surface constituting the housing portion and contacts the lever support portion to move the lever body in the approaching direction and deforms the lever body so as to be capable of releasing the pressing by the holding unit to the lever body, when the operation unit is pulled in an opening direction with respect to the housing of the operation surface along the movable direction while the lever body is positioned at the second position.

Advantageous Effects of Invention

According to the push-button switch, the housing has a deformation portion that contacts the lever support portion to move the lever body and deforms the lever body so as to be capable of releasing the pressing by the holding unit to the lever body when the operation unit is pulled in the opening direction in which the operation unit is separated from the housing while the lever body is positioned at the second position. Due to this deformation portion, when the lever body is held by the holding unit in a state in which the lever body is positioned at the second position and the movable contact portion is in contact with the fixed contact portion, even if the operation unit is pulled in the opening direction to be separated from the housing, since the holding of the lever body by the holding unit can be released and the movable contact portion can be separated from the fixed contact portion, it is possible to realize a push-button switch capable of easily ensuring safety.

DESCRIPTION OF EMBODIMENTS

Figure 1:
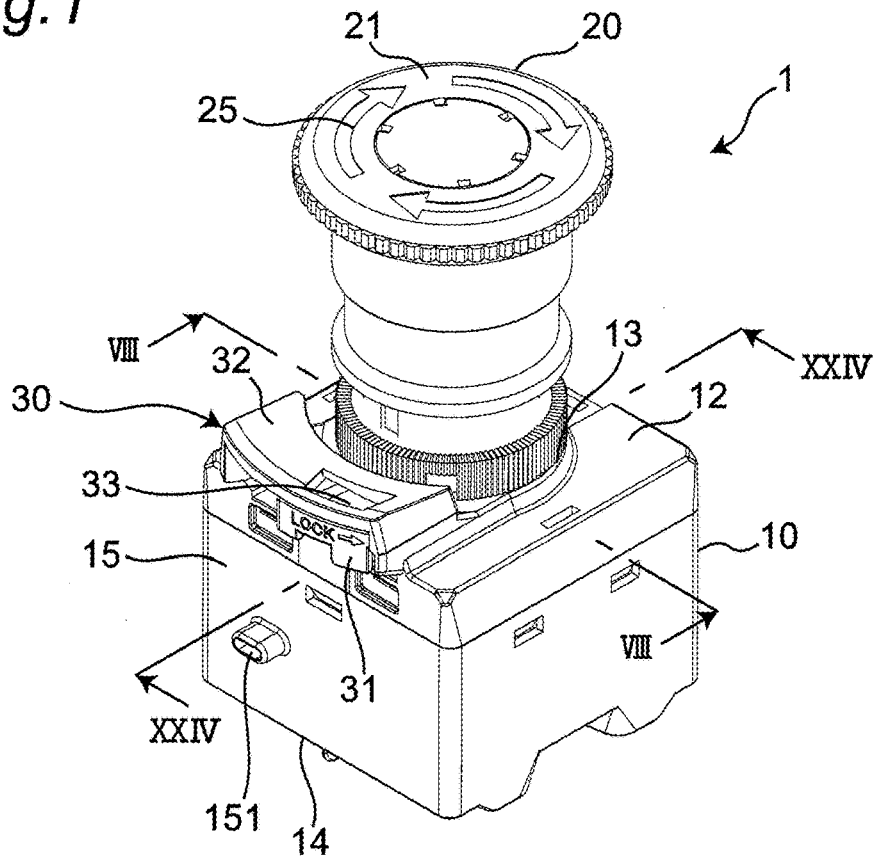
FIG. 1 is a perspective view of a push-button switch according to an embodiment of the present disclosure.

Hereinafter, an example of the present disclosure will be described with reference to the accompanying drawings. In the following description, terms indicating a specific direction or position (for example, terms including "up", "down", "right", "left") will be used as necessary. However, they are used for facilitating understanding of the present disclosure with reference to the drawings, and the technical scope of the present disclosure is not limited by the meaning of those terms. It should be noted that the following description is merely exemplary in nature and is not intended to limit the present disclosure, its application, or its use. Furthermore, the drawings are schematic, and the ratios of the dimensions do not always match actual ones.

As shown in FIGS. 1 to 7, a push-button switch 1 according to an embodiment of the present disclosure includes a substantially cubic housing 10, an operation unit 20 attached to the housing 10, and a lock lever unit 30 provided so as to be exposed to an outside of the housing 10.

The housing 10 has an operation surface 12 on which an operation hole 13 is provided. The operation hole 13 has, for example, a substantially circular shape. The operation unit 20 extends from the outside to the inside of the housing through the operation hole 13 in a movable direction (hereinafter, simply referred to as a movable direction) intersecting (for example, orthogonally) with the operation surface 12, and one end thereof in the extending direction is positioned inside the housing 10 and is attached to the housing 10 in a movable state along the movable direction. Further, the lock lever unit 30 is disposed at an edge of the operation surface 12 of the housing 10.

Figure 8:
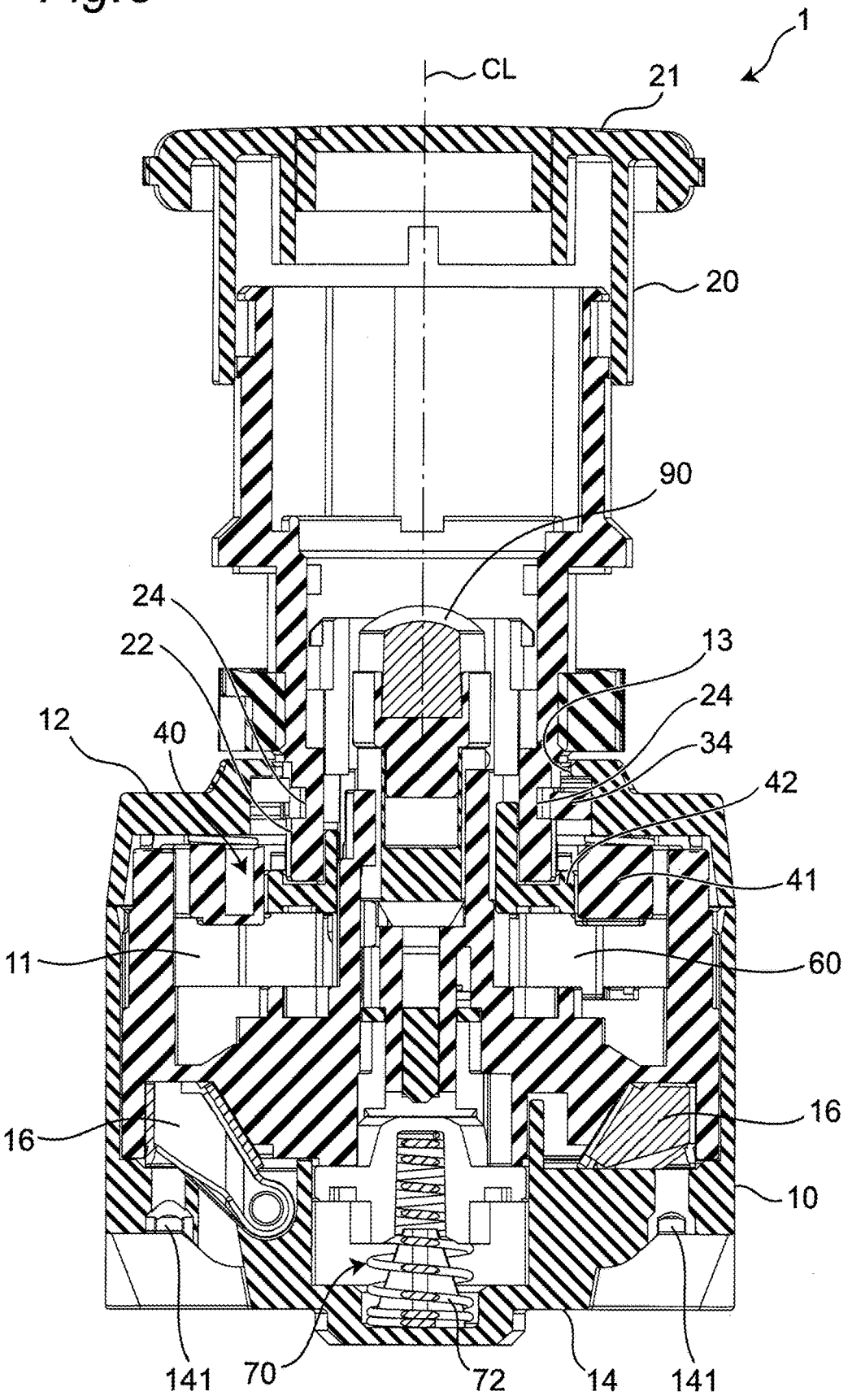
FIG. 8 is a sectional view taken along a line VIII-VIII in FIG. 1.

As shown in FIG. 8, a housing portion 11 connected to the operation hole 13 is provided inside the housing 10. That is, one end of the operation unit 20 in the extending direction is disposed inside the housing portion 11. Inside the housing portion 11, a plunger 40 having a first plunger 41 and a second plunger 42, a transmission mechanism 50 (shown in FIGS. 19 and 20), a contact mechanism 60, and a biasing portion 70 are provided.

The plunger 40 is disposed at an end of the housing portion 11 on the operation surface 12 side in the movable direction, and the biasing portion 70 is disposed at an end of the housing portion 11 on the terminal connection surface 14 side facing the operation surface 12 in the movable direction. In addition, the transmission mechanism 50 and the contact mechanism 60 are arranged between the plunger 40 and the biasing portion 70.

Subsequently, each configuration of the push-button switch 1 will be described.

Figure 2:
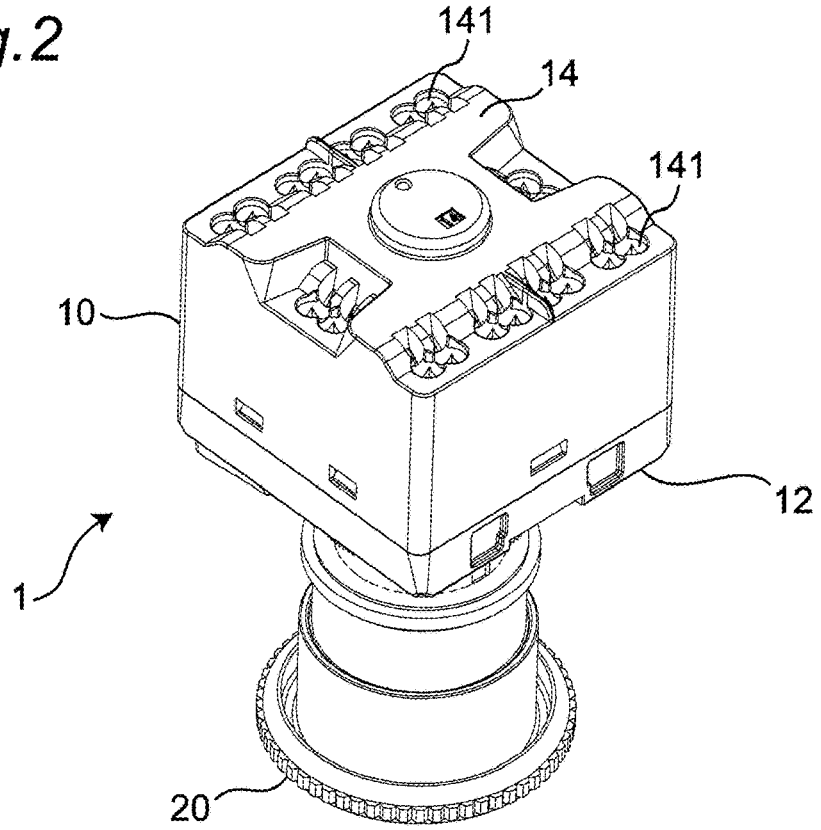
FIG. 2 is a perspective view of the push-button switch of FIG. 1 when viewed from a direction different from that of FIG. 1.

As shown in FIGS. 1 and 2, the housing 10 has the terminal connection surface 14 facing the operation surface 12 and four side surfaces extending in a direction intersecting the operation surface 12 and the terminal connection surface 14 (e.g., an orthogonal direction), and one of the four side surfaces constitutes a fulcrum forming surface 15.

Figure 3:
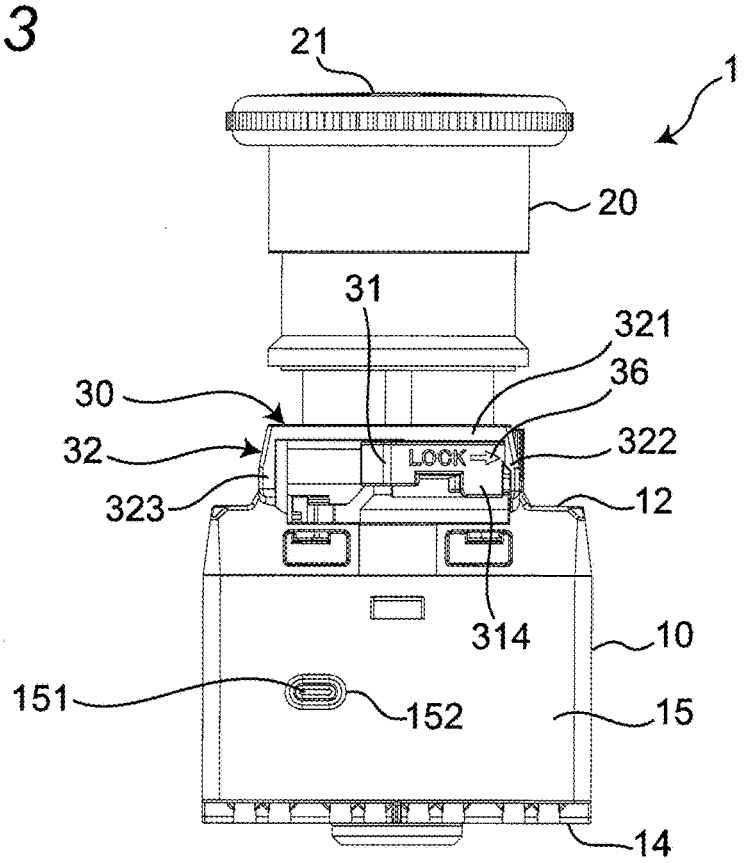
FIG. 3 is a front view of the push-button switch of FIG. 1.
Figure 4:
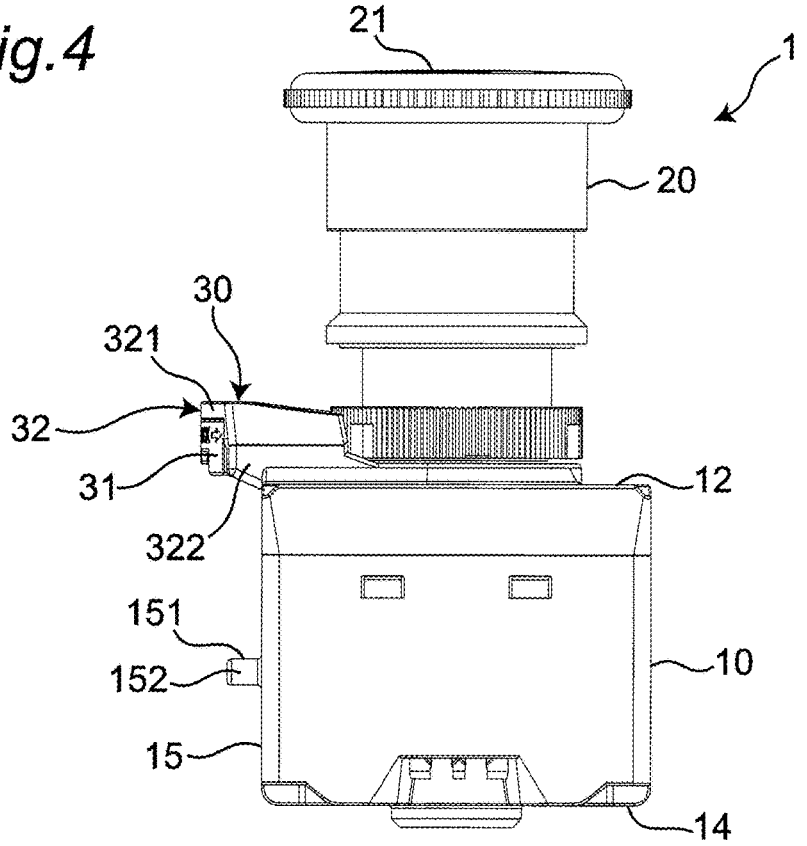
FIG. 4 is a right-side view of the push-button switch in FIG. 1.
Figure 5:
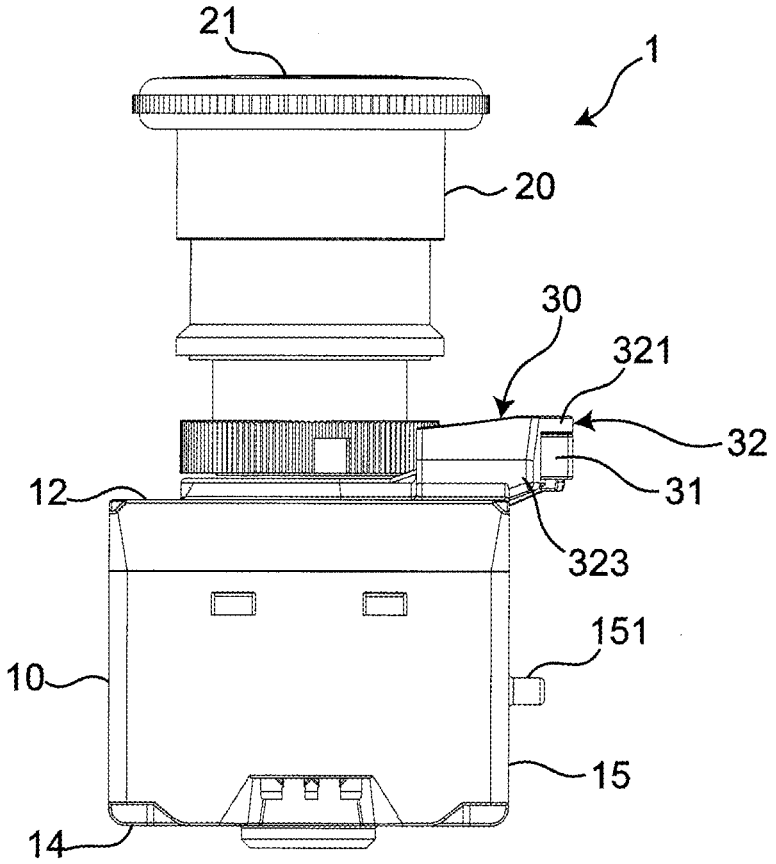
FIG. 5 is a left-side view of the push-button switch of FIG. 1.

The fulcrum forming surface 15 is provided with a fulcrum projection 151 protruding from the fulcrum forming surface 15 toward the outside of the housing 10 in a direction intersecting with the fulcrum forming surface 15 (for example, an orthogonal direction). As shown in FIG. 3, the fulcrum projection 151 has an oval shape extending in a direction orthogonal to the movable direction when viewed from a direction orthogonal to the fulcrum forming surface 15 and is disposed in the middle between the operation surface 12 and the terminal connection surface 14 and at one side of the center of the fulcrum forming surface 15 in a direction orthogonal to the movable direction.

Specifically, the fulcrum projection 151 is, when viewed from a direction orthogonal to the fulcrum forming surface 15, disposed closer to a first position P1 than a center line CL (see FIGS. 25 and 26) extending in the movable direction of the operation unit 20 passing through the center between the first position P1 and a second position P2 in a moving direction of the lever body 31.

The fulcrum projection 151 is configured such that one curved surface 152 in an extending direction thereof, when the lever body 31 of the lock lever unit 30 described later is moved from the first position P1 to the second position P2 using a long jig 100 (see FIGS. 25 and 26), comes into contact with an intermediate portion 102 of the jig 100 in which a distal end 101, which is one end of the jig 100, is locked to a locking portion 312 of the lock lever unit 30 described later, and serves as a rotation fulcrum of the jig 100. That is, the curved surface 152 is provided at a portion that comes into contact with the intermediate portion 102 of the jig 100, and protrudes from the fulcrum projection 151 toward the jig 100.

Figure 7:
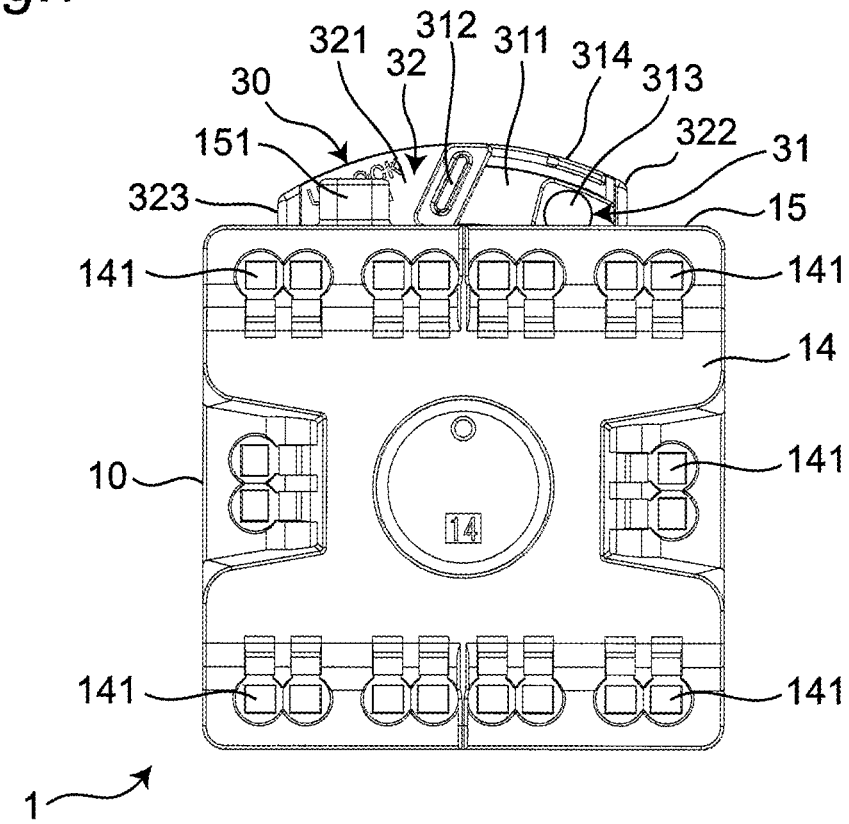
FIG. 7 is a bottom view of the push-button switch of FIG. 1.

As shown in FIG. 7, the terminal connection surface 14 is provided with a plurality of openings 141. Each of the openings 141 is configured so that, for example, a conductor portion of an electric wire (not shown) can be inserted therein, and is connected to a terminal connection mechanism 16 provided inside the housing portion 11 as shown in FIG. 8. As an example, the terminal connection mechanism 16 employs a so-called push-in connection type, and is configured so that the conductor of the electric wire can be connected to the push-button switch 1 simply by inserting the conductor of the electric wire from the opening 141.

As shown in FIG. 1, the operation unit 20 has a substantially cylindrical shape and has a pressing surface 21 provided outside the housing 10 and disposed so as to face the operation surface 12. The operation unit 20 is configured to be able to perform an approaching operation in which the pressing surface 21 approaches the operation surface 12 along the movable direction, and is configured so that the plunger 40 is positioned at a later-described return position P3 (see FIG. 19) by this approaching operation. Specifically, when the plunger 40 is at the non-return position other than the return position P3 (specifically, when the second plunger 42 is at a non-return position other than the return position P32), an end 22 of the operation unit 20 on the housing portion 11 side moves from an initial position (shown in FIG. 8) to a pressing position, and the operation unit 20 moves the plunger 40 along the movable direction to the return position P3 (specifically, moves the second plunger 42 along the movable direction to the return position P32).

Figure 6:
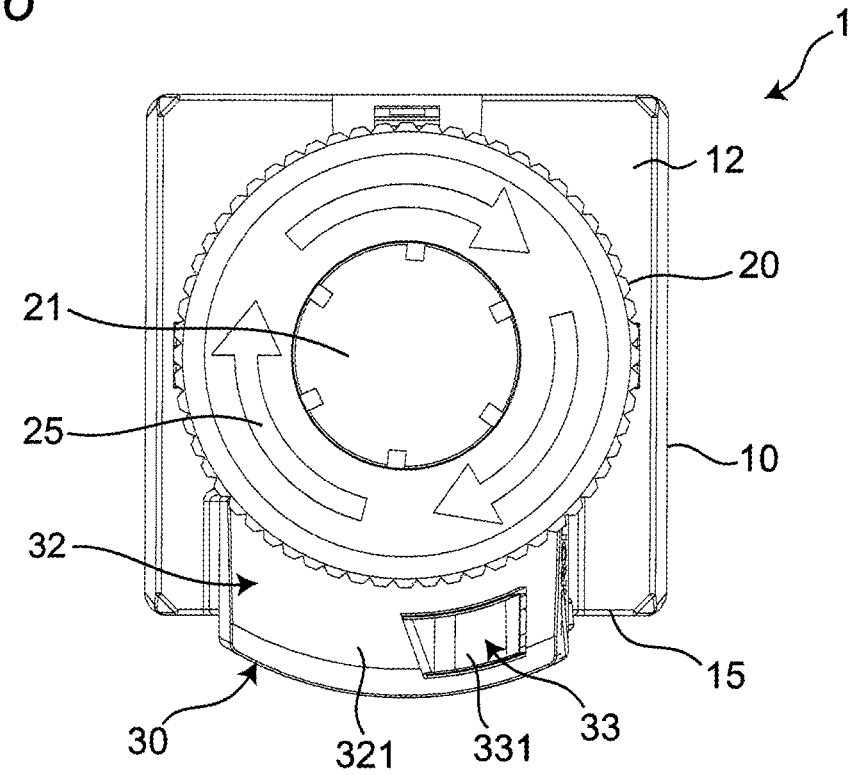
FIG. 6 is a plan view of the push-button switch of FIG. 1.

As shown in FIGS. 1 and 6, the pressing surface 21 is provided with a display portion 25 that indicates the rotation direction of the operation unit 20 when the operation unit 20 is attached to the housing 10. The display portion 25 is configured by a clockwise arrow when viewed from an approaching direction in which the pressing surface 21 approaches the operation surface 12 in the movable direction (hereinafter, simply referred to as an approaching direction).

Figure 9:
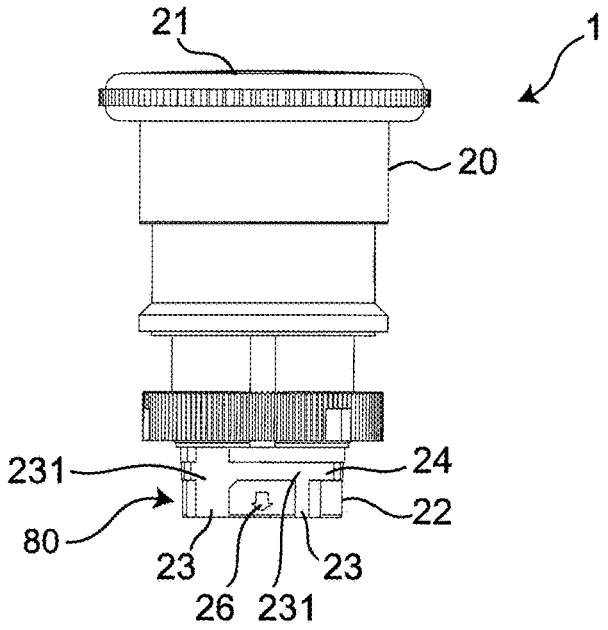
FIG. 9 is a front view of an operation unit of the push-button switch of FIG. 1.
Figure 10:
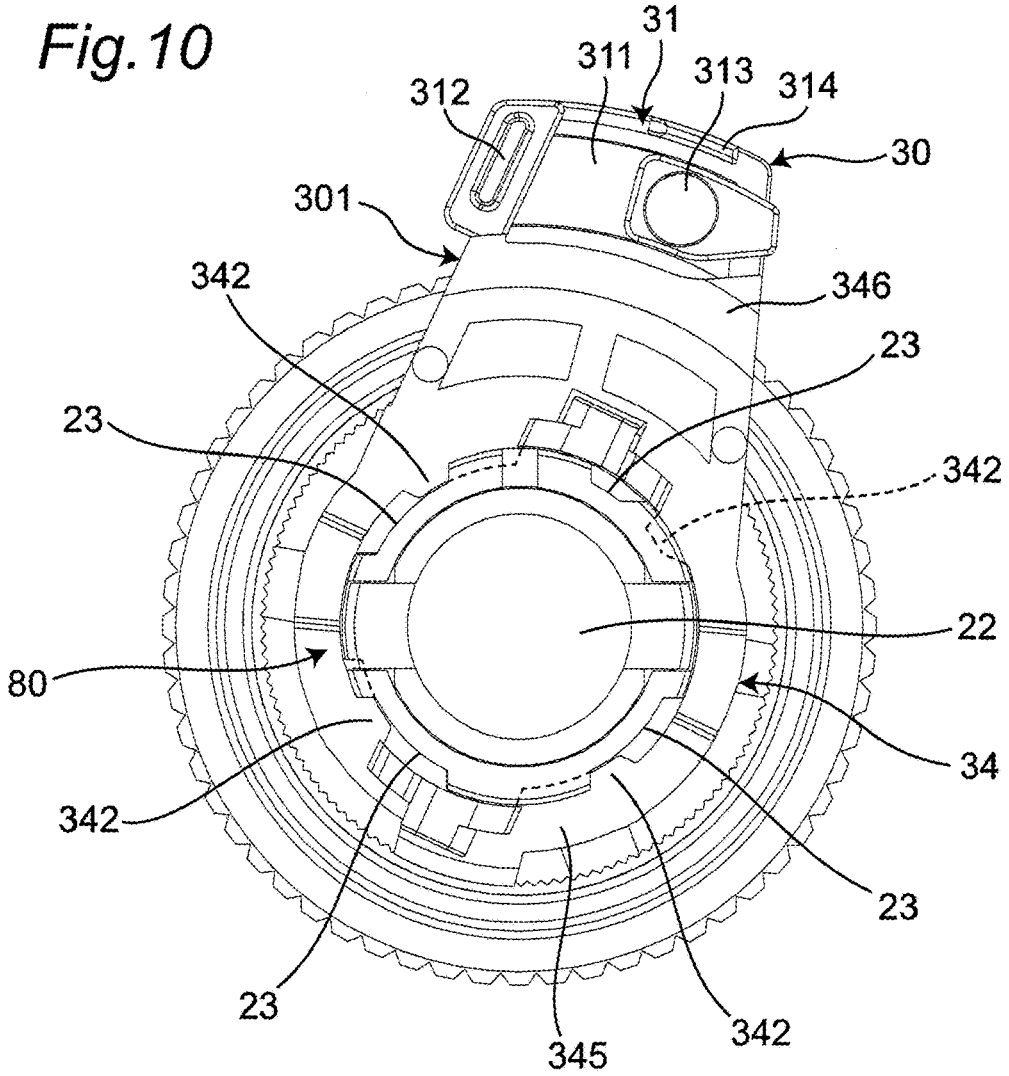
FIG. 10 is a bottom view of the operation unit and a lock lever unit of the push-button switch of FIG. 1.

As shown in FIG. 9, a first groove 23 extending in the movable direction and a second groove 24 connected to an end 231 of the first groove 23 on the pressing surface 21 side in the movable direction and extending in the circumferential direction of an end 22 of the operation unit 20 on the housing portion 11 side are provided on an outer circumferential surface of the end 22 of the operation unit 20 on the housing portion 11 side. The first groove 23 and the second groove 24 are configured to be capable of housing a locking projection 342 provided on the lock lever unit 30 described later. Further, when the lever body 31 is positioned at the first position P1, the first groove 23 is capable of housing the locking projection 342, and the second groove 24 is, as shown in FIG. 10, configured to be capable of locking the locking projection 342 in the movable direction, when the lever body 31 is at the second position P2.

The locking projection 342 of the lock lever unit 30 and the first groove 23 and the second groove 24 of the operation unit 20 constitute a movement regulating portion 80. When the lever body 31 is positioned at the first position P1, the movement regulating portion 80 enables movement of the lever body 31 to the second position P2 when the end 22 of the operation unit 20 on the housing portion 11 side is positioned at the initial position (that is, as shown in FIG. 9, a position of the end 22 of the operation unit 20 on the housing portion 11 side when the locking projection 342 is positioned at the end 231 of the first groove 23 on the pressing surface 21 side in the movable direction), but it disables movement by regulating movement of the lever body 31 to the second position P2 when the end 22 of the operation unit 20 on the housing portion 11 side is positioned closer to the operation surface 12 than the initial position in the movable direction. When the end 22 of the operation unit 20 on the housing portion 11 side is positioned at the initial position, the first groove 23 and the second groove 24 are connected so that the operation unit 20 can be rotated only in one direction (in this embodiment, the arrow direction of the display portion 25). That is, the movement regulating portion 80 is provided between the operation unit 20 and the lock lever unit 30 inside the housing portion 11, and can confirm whether or not the operation unit 20 has been securely attached to the housing 10 depending on whether or not the lever body 31 can be moved to the second position P2.

In addition, on the outer circumferential surface of the end 22 of the operation unit 20 on the housing portion 11 side, a display portion 25 (in this embodiment, an arrow in a direction from the pressing surface 21 toward the end 22 on the housing portion 11 side in the movable direction) indicating the mounting direction of the operation unit 20 to the housing 10 is provided.

Figure 13:
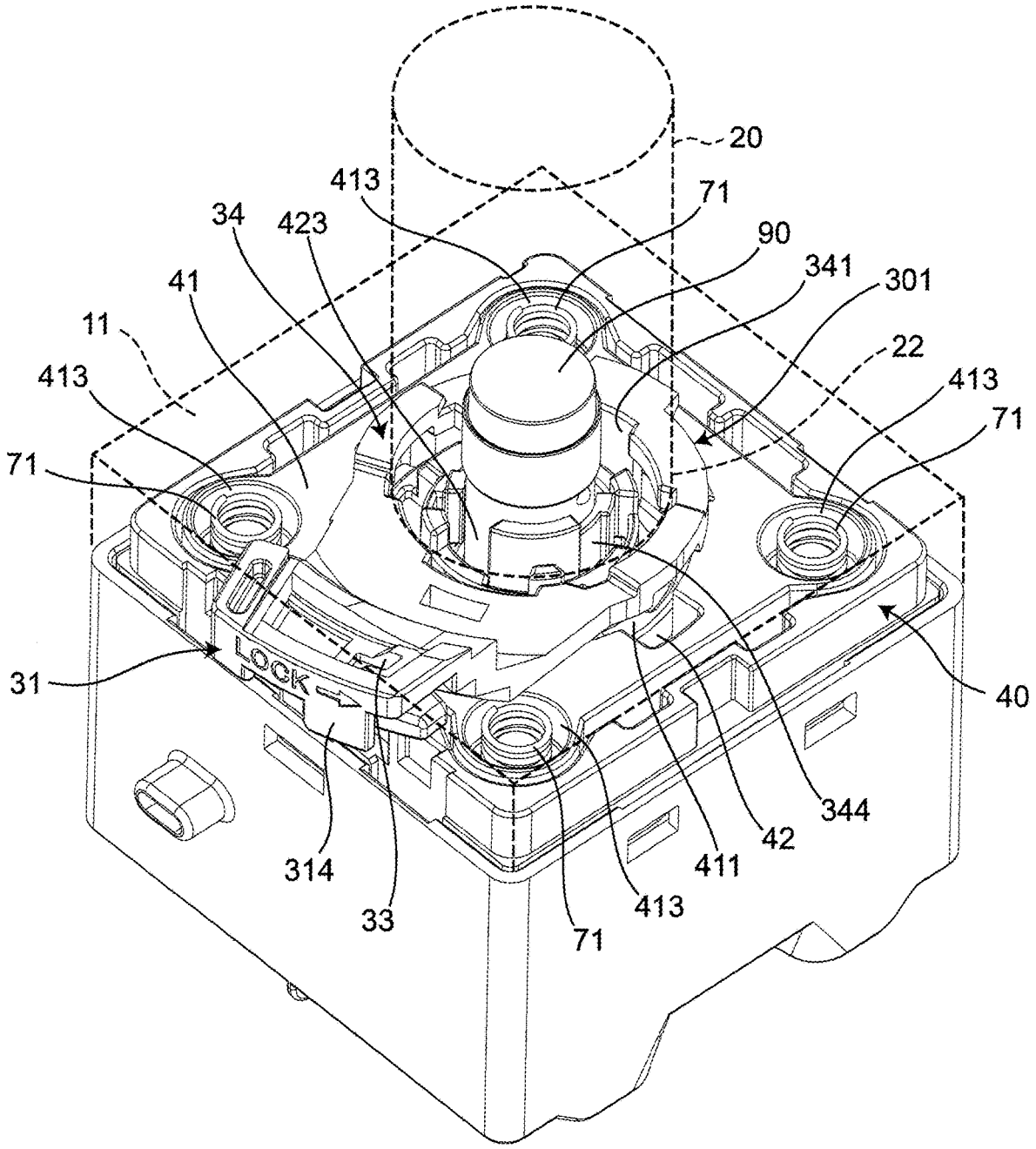
FIG. 13 is a perspective view of the push-button switch of FIG. 1 with a part of housing and an operation unit made transparent.

As shown in FIG. 1, the lock lever unit 30 includes a lever portion 301 and an exterior portion 32 fixed to the housing 10 so as to cover the lever portion 301. As shown in FIG. 13, the lever portion 301 has the lever body 31 exposed to the outside of the housing 10, and a lever support portion 34 disposed in the housing portion 11.

As shown in FIG. 7, the lever body 31 intersects (e.g., orthogonally) with the fulcrum forming surface 15 from the fulcrum forming surface 15 and protrudes in a direction away from the fulcrum forming surface 15, and as shown in FIG. 3, is disposed between the pressing surface 21 and the operation surface 12 in the movable direction. When viewed from a direction orthogonal to the fulcrum forming surface 15, the lever body 31 is configured to be movable in a direction (for example, the orthogonal direction) intersecting the movable direction between the first position P1 (see FIG. 24) and the second position P2 (see FIG. 25).

As shown in FIGS. 6 and 7, the exterior portion 32 includes a first wall portion 321 that faces an upper surface (that is, a surface on the opposite side in the movable direction of a facing surface 311 (shown only in FIG. 7) facing the operation surface 12 of the lever body 31) in the movable direction of the lever body 31 and extends in the moving direction of the lever body 31, and a second wall portion 322 and a third wall portion 323 respectively arranged on both sides of the lever body 31 in a direction orthogonal to the movable direction (that is, the moving direction of the lever body 31) and respectively connected to the first wall portion 321 and the operation surface 12 of the housing 10. The moving range of the lever body 31 is defined by the exterior portion 32.

Figure 11:
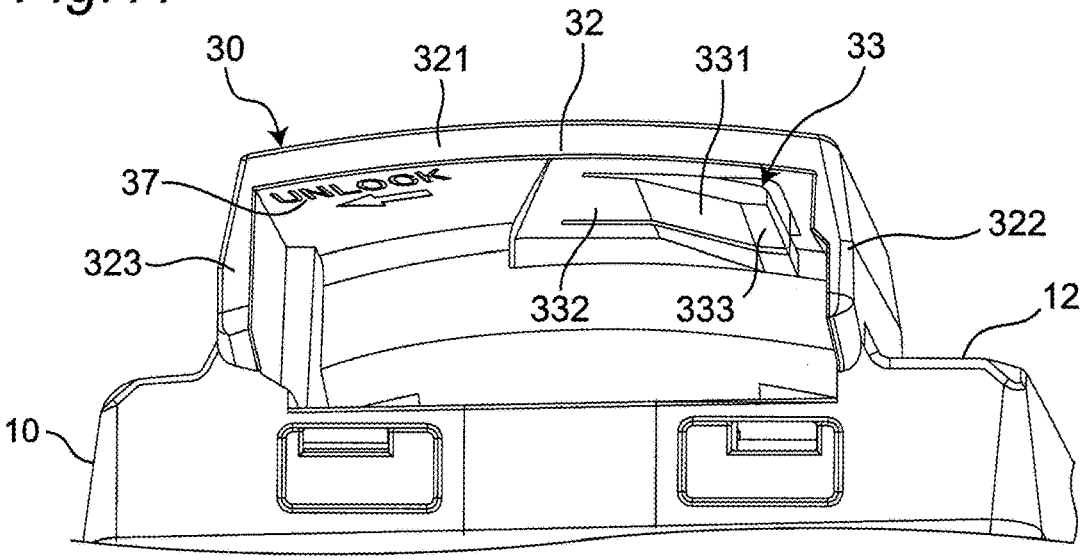
FIG. 11 is a perspective view showing an exterior portion of the push-button switch of FIG. 1.

As shown in FIG. 6, a holding unit 33 capable of holding the lever body 31 at the second position P2 is provided at one end (that is, the right end in FIG. 6) of the first wall portion 321 in the extending direction. Specifically, as shown in FIG. 11, the holding unit 33 has an elastic holding portion 331 capable of holding the lever body 31 by pressing the lever body 31 from one side to the other side (that is, from an upper side to a lower side in FIG. 11) in the movable direction at the second position P2. The elastic holding portion 331 extends in the extending direction of the first wall portion 321, an end 332 on the other end side (that is, the left side in FIG. 11) thereof in the extending direction of the first wall portion 321 is connected to the first wall portion 321, and an end 333 on one end side thereof in the extending direction of the first wall portion 321 is disposed between the first wall portion 321 and the operation surface 12 and configured to be elastically deformable in a direction away from the operation surface 12 in the movable direction.

Further, as shown in FIG. 11, a display portion 37 is provided on the first position P1 side (that is, the left side in FIG. 11) of the surface of the first wall portion 321 facing the operation surface 12. The display portion 37 is composed of characters "UNLOCK" and arrows indicating the direction from the second position P2 toward the first position P1.

As shown in FIG. 7, a locking portion 312 and a hold releasing portion 313 are provided on the facing surface 311 of the lever body 31. The locking portion 312 is configured to be capable of locking a distal end 101 (see FIGS. 25 and 26) which is one end in the extending direction of the long jig 100 used for moving the lever body 31 from the first position P1 to the second position P2. Further, the hold releasing portion 313 is configured to be capable of releasing holding of the lever body 31 by the elastic holding portion 331 by pressing the lever body 31 from the other side to one side (that is, from the near side to the back in the paper penetration direction in FIG. 7) in the movable direction at the second position P2.

Further, the lever body 31 is provided with a protection wall 314 that is disposed on the opposite side (that is, on the upper side in FIG. 7) of the fulcrum forming surface 15 with respect to the hold releasing portion 313 in a direction intersecting with the fulcrum forming surface 15 and protects the hold releasing portion 313 in the direction intersecting with the fulcrum forming surface 15.

Figure 12:
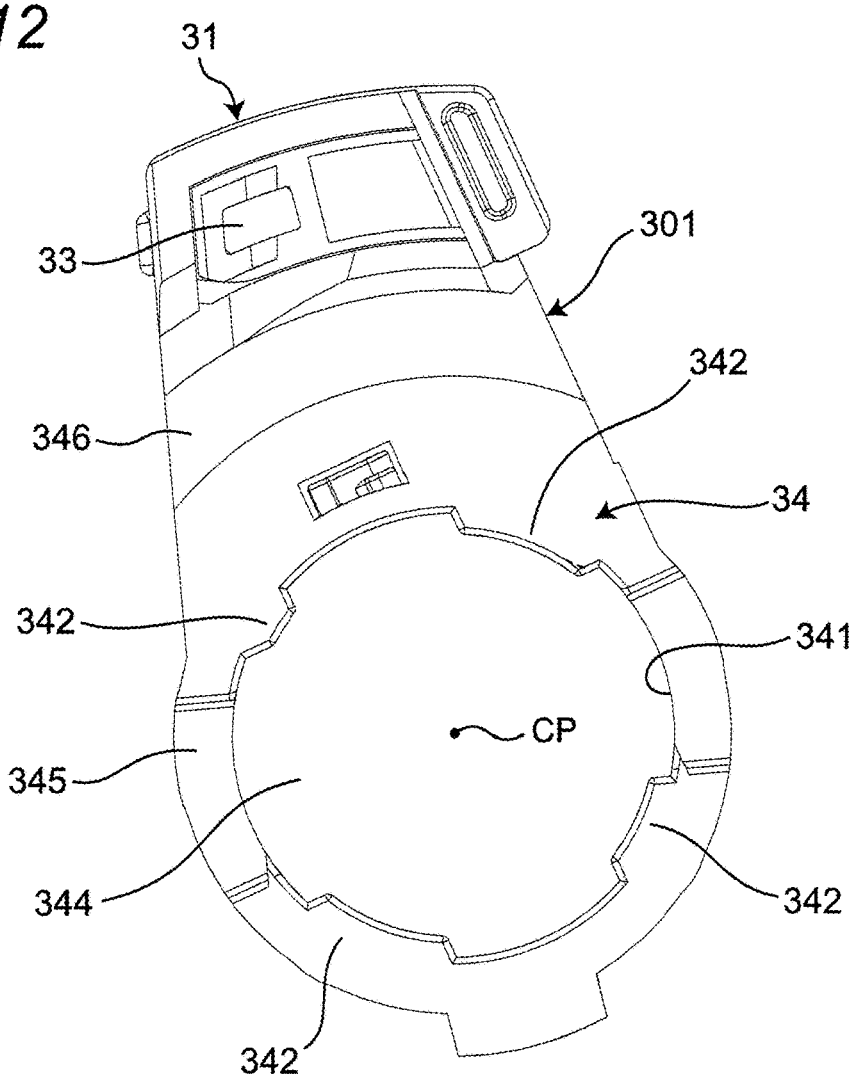
FIG. 12 is a top view of a lever portion of the push-button switch of FIG. 1.

Further, as shown in FIG. 12, the lock lever unit 30 has the lever support portion 34 connected to the lever body 31 so as to be movable together with the lever body 31. As shown in FIG. 13, the lever support portion 34 is provided inside the housing portion 11 to surround the end 22 of the operation unit 20 on the housing portion 11 side in the circumferential direction (that is, around the movable direction), and is disposed so that an inner circumferential surface 341 of the lever support portion 34 faces the end 22 of the operation unit 20 on the housing portion 11 side.

As shown in FIG. 12, the lever support portion 34 is provided with the locking projection 342 that protrudes from the inner circumferential surface 341 toward the operation unit 20 (that is, toward the radial inside of the lever support portion 34). In this embodiment, as an example, four locking projections 342 are arranged at intervals in the circumferential direction of the inner circumferential surface 341 of the lever support portion 34.

Figure 14:
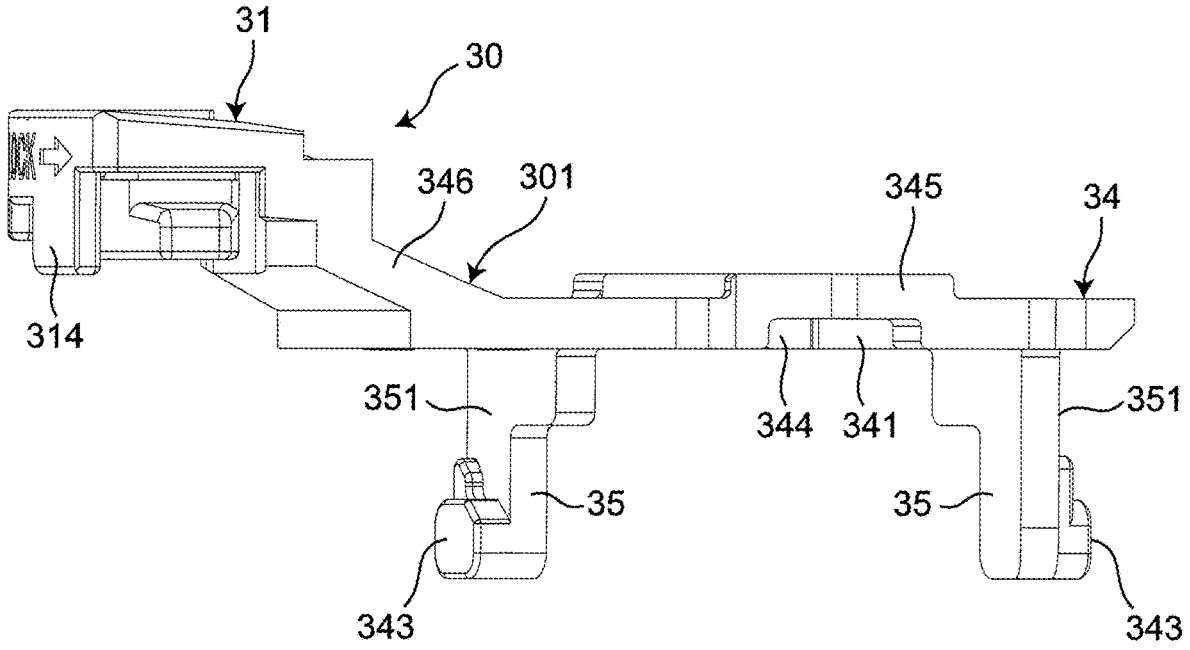
FIG. 14 is a right-side view of the lever portion of the push-button switch of FIG. 1.

In addition, as shown in FIG. 14, the lever support portion 34 includes a lever connection portion 345, which is an example of a connection portion, and an inclined portion 346.

The lever connection portion 345 has a substantially annular shape, extends along the operation surface 12, and houses the end 22 of the housing portion 11 of the operation unit 20 in a substantially circular through hole 344 at the center thereof. That is, the lever body 31 rotates around a rotation axis that passes through the center of the lever connection portion 345 and extends in the movable direction. Further, the lever connection portion 345 is connected to the operation unit 20 in a movable state in the movable direction together with the operation unit 20 when the lever body 31 is at the second position P2. The inclined portion 346 is connected to the lever connection portion 345 and the lever body 31, and is inclined from the lever connection portion 345 toward the lever body 31 in an opening direction from the operation surface 12 toward the pressing surface 21 (hereinafter simply referred to as an opening direction) along the movable direction.

The lever connection portion 345 is provided with a plurality of cam projections 343 (in this embodiment, as an example, two cam projections 343) protruding radially outward from the outer circumferential surface of the lever support portion 34. Specifically, the cam projections 343 are provided respectively on the outer circumferential surfaces 351 of a pair of legs 35 extending from the edge of the through hole 344 of the lever connection portion 345 along the movable direction in the direction away from the operation surface 12. Further, each cam projection 343 has a quadrangular shape in which all corners are chamfered when viewed from the protruding direction. Each leg 35 is disposed on the same straight line passing through a center CP (shown in FIG. 12) of the through hole 344, and each cam projection 343 is configured so as to be engageable with each of a plurality of cam grooves 412 of the first plunger 41 described later.

Note that the transmission mechanism 50 is configured by the lever support portion 34, the plurality of cam projections 343, and the plurality of cam grooves 412. That is, the transmission mechanism 50 is disposed between the lock lever unit 30 and the plunger 40.

As shown in FIG. 3, the lever body 31 is provided with a display portion 36 on an exposed side surface that is not covered by the exterior portion 32 when viewed from a direction orthogonal to the fulcrum forming surface 15. The display portion 36 is composed of characters "LOCK" and arrows indicating the direction from the first position P1 to the second position P2.

Figure 15:
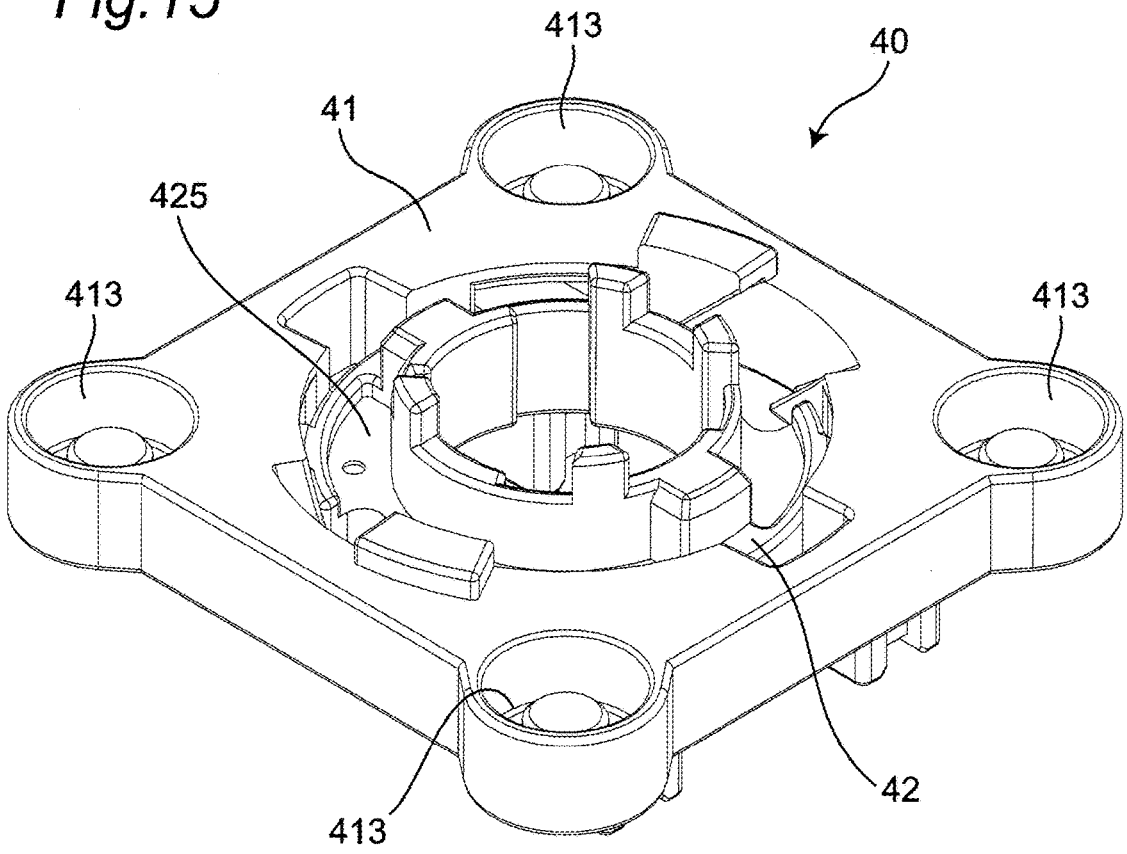
FIG. 15 is a perspective view of a plunger of the push-button switch of FIG. 1.

As shown in FIG. 8, the plunger 40 is disposed at the end on the operation surface 12 side inside the housing portion 11, and is configured to be movable along the movable direction between a return position P3 (see FIG. 19) away from the operation surface 12 and an operating position (see FIG. 20) in the middle of the operation surface 12 and the return position P3. More specifically, as shown in FIG. 15, the plunger 40 has the first plunger 41 in a substantially rectangular plate shape and the second plunger 42 disposed in series with the first plunger 41 along the movable direction and disposed away from the operation surface 12. The first plunger 41 and the second plunger 42 are not connected and are configured to be movable independently of each other.

Figure 16:
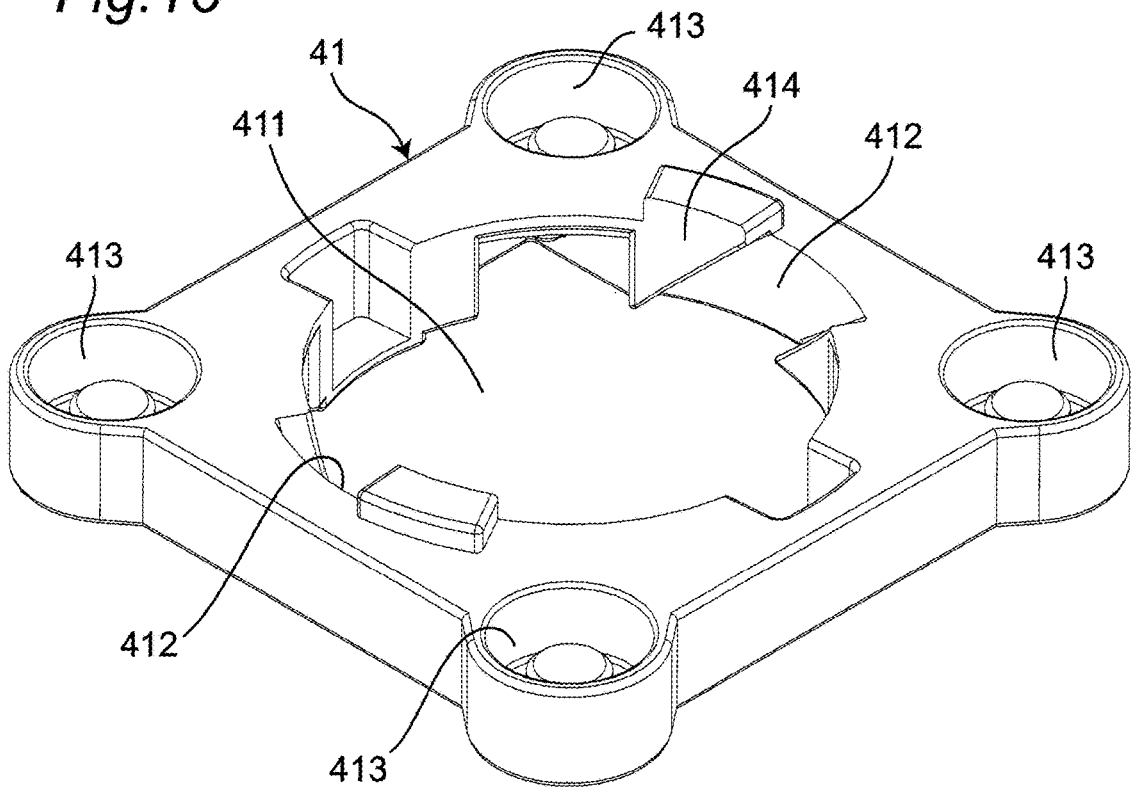
FIG. 16 is a perspective view of a first plunger of the push-button switch of FIG. 1.

As shown in FIG. 16, the first plunger 41 has a substantially circular through hole 411 provided at a substantially central portion and penetrating in a movable direction and a plurality of cam grooves (in this embodiment, as an example, two cam grooves) 412 provided on an inner circumferential surface 414 and mutually arranged at intervals (for example, at 180 degrees) in the circumferential direction of the inner circumferential surface 414. In the through hole 411, as shown in FIG. 13, the end 22 of the operation unit 20 on the housing portion 11 side is housed so as to be rotatable in the circumferential direction (that is, around the movable direction) of the inner circumferential surface 414.

Each cam groove 412, as viewed from the approaching direction, is inclined in a direction approaching the operation surface 12 (in other words, so as to be away from the operation surface 12 along the moving direction from the first position P1 toward the second position P2 of the lever body 31) as it advances in a clockwise direction along the circumferential direction of the inner circumferential surface 414 of the through hole 411, and is disposed so as to be engageable with each cam projection 343 of the lever support portion 34 of the lock lever unit 30. In other words, the inner circumferential surface 414 of the through hole 411 faces the outer circumferential surface 351 of each leg 35 of the lever support portion 34, and each cam groove 412 corresponds to each cam projection 343. Further, at each corner of the first plunger 41, a circular recess 413 is provided. As shown in FIG. 13, a coil spring 71 is housed in each recess 413.

Figure 17:
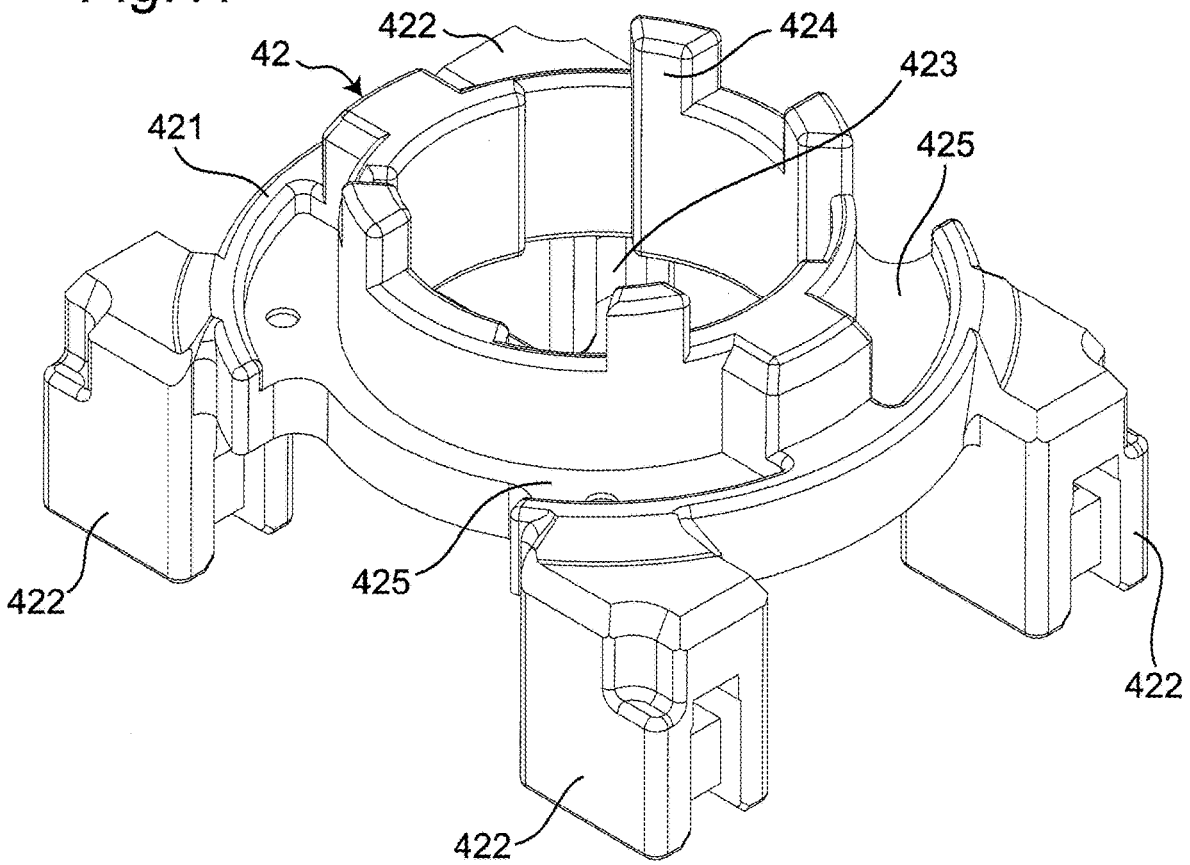
FIG. 17 is a perspective view of a second plunger of the push-button switch of FIG. 1.

As shown in FIG. 17, the second plunger 42 is provided with an annular main body 421 having a through hole 423 provided in the center, and a plurality of plunger connection portions (in this embodiment, as an example, four plunger connection portions) 422 provided radially outside the main body 421.

The main body 421 is provided with an annular wall 424 protruding in a direction approaching the operation surface 12 from the peripheral portion of the through hole 423 at the center thereof along the movable direction (that is, upward in FIG. 17). The annular wall 424 is configured to be insertable into the through hole 411 of the first plunger 41. A partially annular recess 425 for housing the end 22 of the operation unit 20 on the housing portion 11 side is formed radially outside the annular wall 424 of the main body 421.

The plunger connection portions 422 are arranged at intervals along the circumferential direction of the outer circumferential surface of the main body 421. Each plunger connection portion 422 has a substantially rectangular parallelepiped shape extending from the main body 421 along the movable direction in a direction away from the operation surface 12 (that is, downward in FIG. 17), and is connected to the contact mechanism 60.

An LED unit 90 is disposed in the through hole 423 of the second plunger 42, as shown in FIG. 13.

Figure 18:
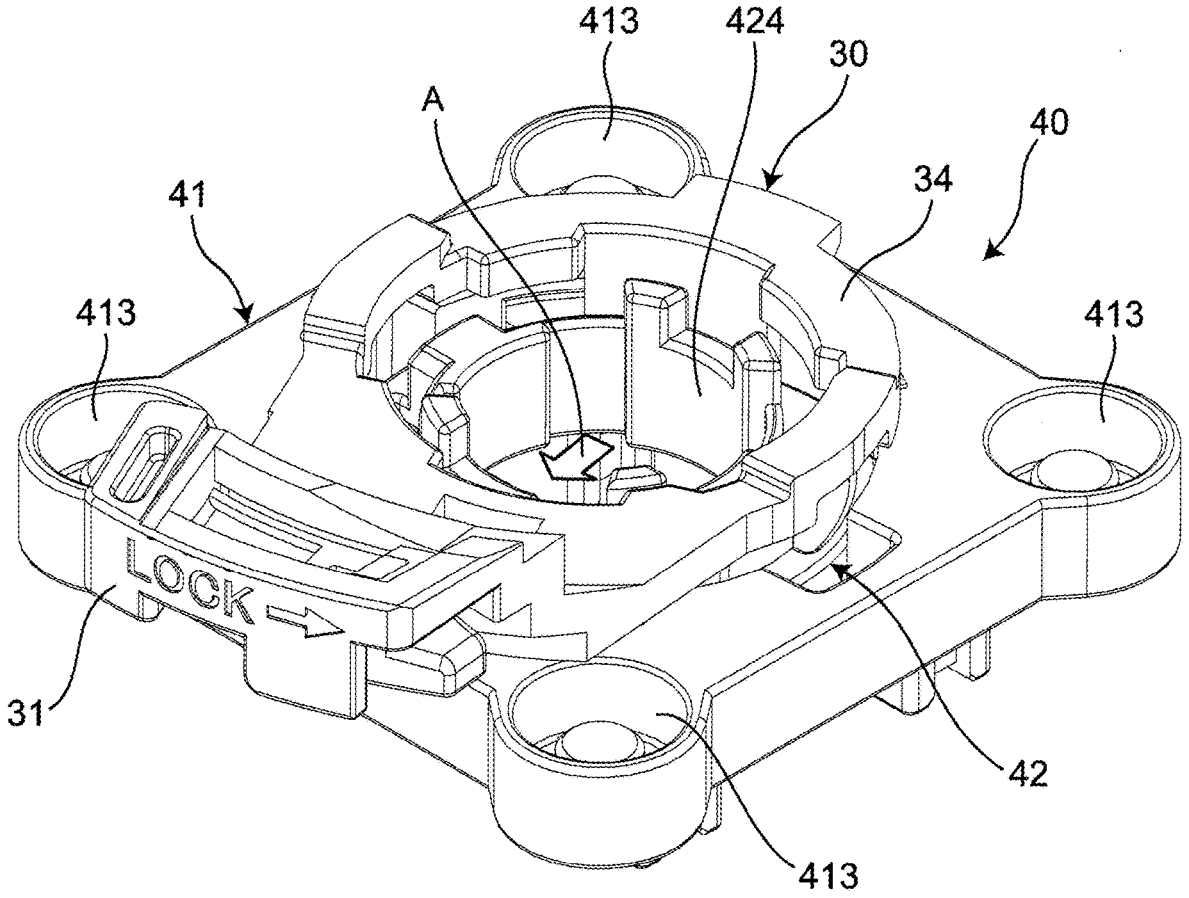
FIG. 18 is a perspective view of the lever portion and the plunger of the push-button switch of FIG. 1.
Figure 19:
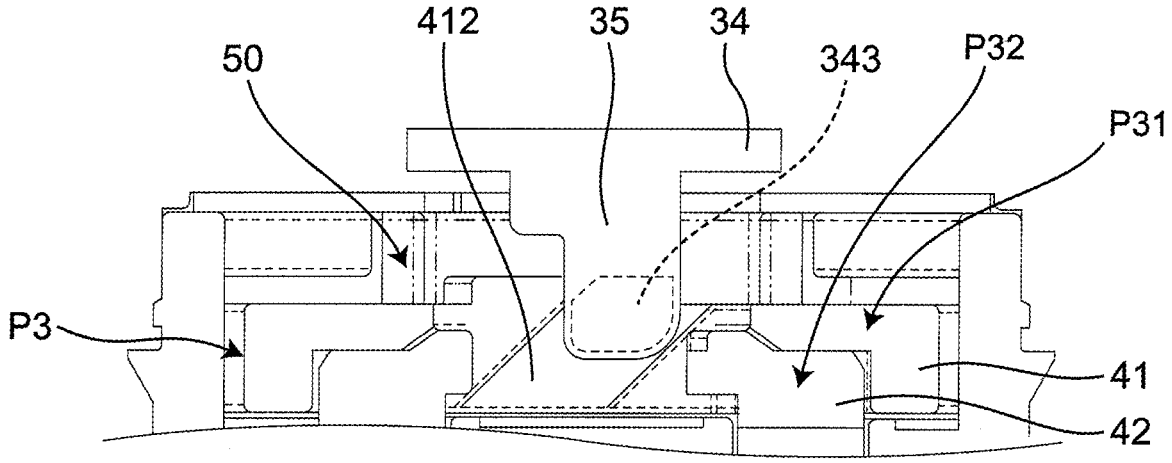
FIG. 19 is a first plan view for explaining the operation of a transmission mechanism of the push-button switch of FIG. 1, as viewed from an arrow A direction in FIG. 18.
Figure 20:
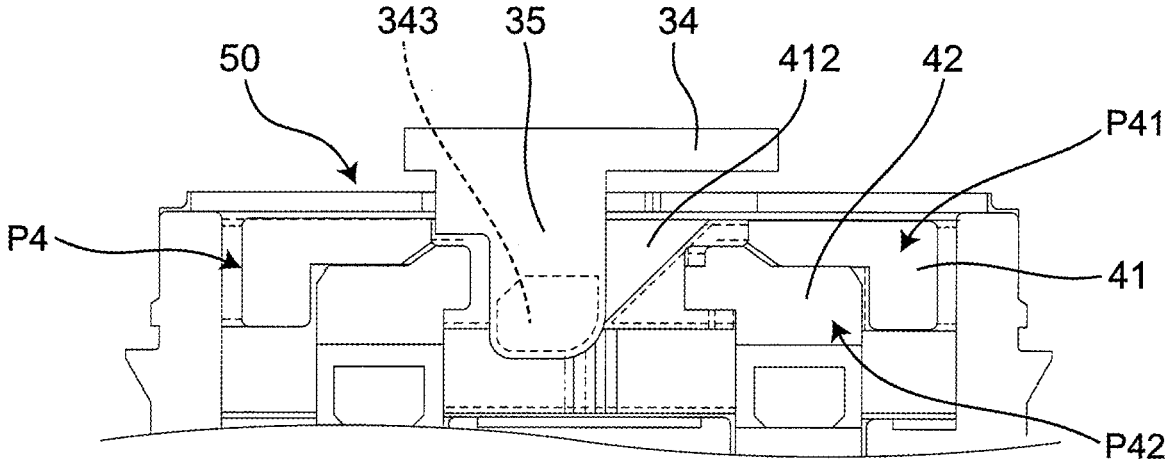
FIG. 20 is a second plan view for explaining the operation of the transmission mechanism of the push-button switch of FIG. 1, as viewed from the arrow A direction in FIG. 18.

FIGS. 18 to 20 show a state in which the lock lever unit 30 and the plunger 40 are connected. FIG. 19 is a plan view showing a state in which the lever body 31 is at the first position P1 and the plunger 40 is at the return position P3 as viewed from the direction indicated by the arrow A in FIG. 18, and FIG. 20 is a plan view showing a state in which the lever body 31 is at the second position P2 and the plunger 40 is at the operating position P4 as viewed from the direction indicated by the arrow A in FIG. 18.

As shown in FIGS. 19 and 20, the first plunger 41 is configured to move from the return position P31 to the operating position P41 when the lever body 31 is moved from the first position P1 to the second position P2 by the transmission mechanism 50, and move from the operating position P41 to the return position P31 when the lever body 31 is moved from the second position P2 to the first position P1. The second plunger 42 is biased by a coil spring 72 described later in a direction approaching the operation surface 12 along the movable direction. Therefore, the second plunger 42 moves from the return position P32 to the operating position P42 with the movement of the first plunger 41 from the return position P3 to the operating position P4, and moves from the operating position P42 to the return position P32 with the movement of the first plunger 41 from the operating position P4 to the return position P3. When the second plunger 42 is not positioned at the return position P32, the second plunger 42 is configured to be movable to the return position P32 along the movable direction by the approaching operation of the operation unit 20. That is, the second plunger 42 is configured to be positioned at the return position P32 by the approaching operation of the operation unit 20. Note that, the second plunger 42, when having moved to the return position P32 due to the approaching operation of the operation unit 20, is held at the return position P32 by the end 22 of the operation unit 20 on the housing portion 11 side.

That is, the transmission mechanism 50 moves the plunger 40 from the return position P3 to the operating position P4 along the movable direction as the lever body 31 moves from the first position P1 toward the second position P2, but it moves the plunger 40 from the operating position P4 to the return position P3 along the movable direction as the lever body 31 moves from the second position P2 toward the first position P1. In other words, the transmission mechanism 50 has a function of transmitting the moving operation of the lever body 31 to the plunger 40.

Figure 21:
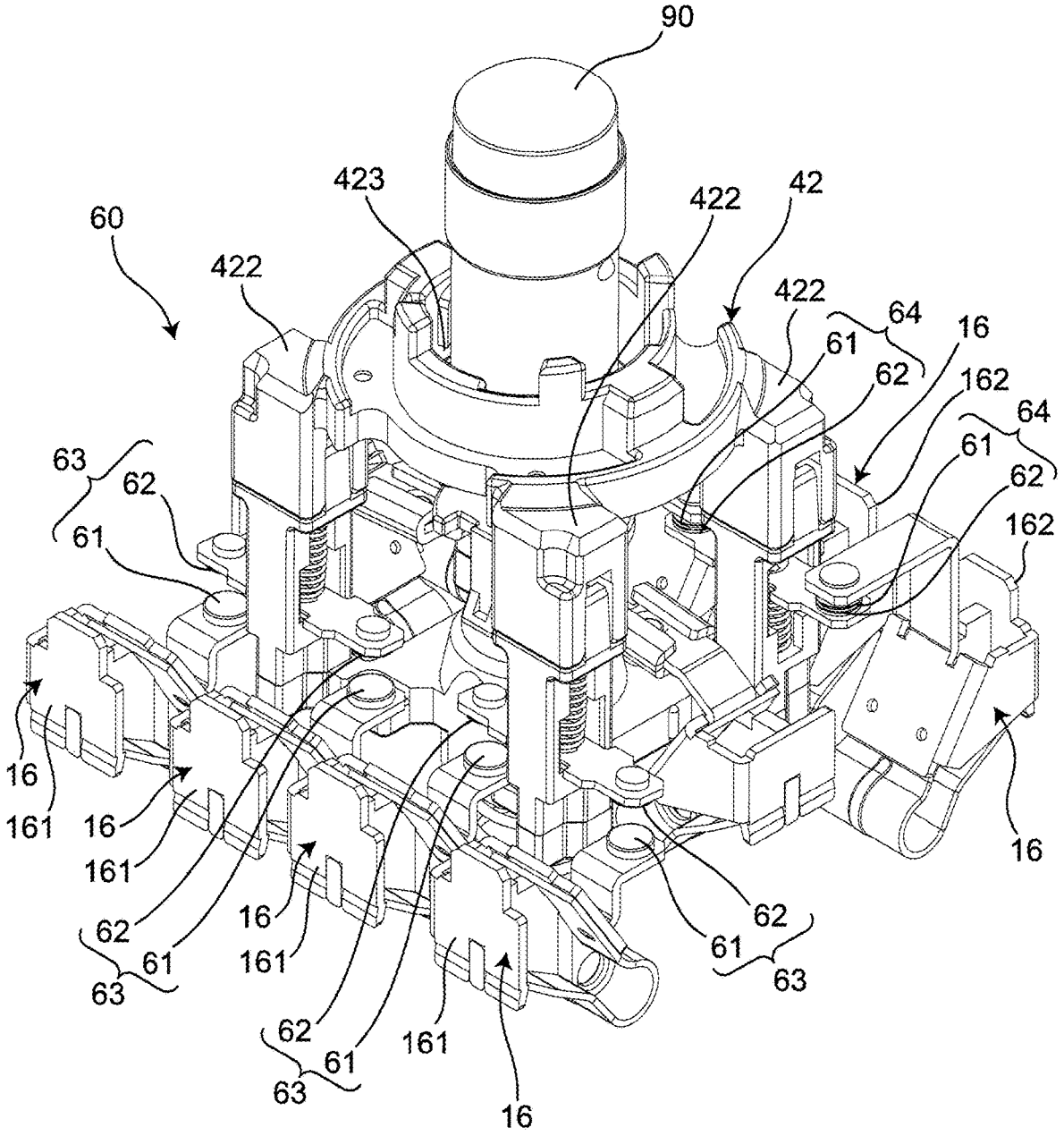
FIG. 21 is a perspective view showing a second plunger, a contact mechanism, and a terminal connection mechanism of the push-button switch of FIG. 1.

As shown in FIG. 21, the contact mechanism 60 includes a plurality of fixed contact portions 61 provided inside the housing portion 11 and a plurality of movable contact portions 62 provided respectively so as to face the fixed contact portions 61 in the movable direction inside the housing portion 11. The fixed contact portions 61 are connected to the terminal connection mechanisms 16, respectively. Each movable contact portion 62 is connected to any one of the four plunger connection portions 422 of the second plunger 42, and is configured to contact the facing fixed contact portion 61 by movement of the second plunger 42 from the return position P32 to the operating position P42 and separate from the fixed contact portion 61 in contact by movement of the second plunger 42 from the operating position P42 to the return position P32. In other words, the contact mechanism 60 is configured to be opened and closed by the movement of the second plunger 42 along the movable direction.

Figure 22:
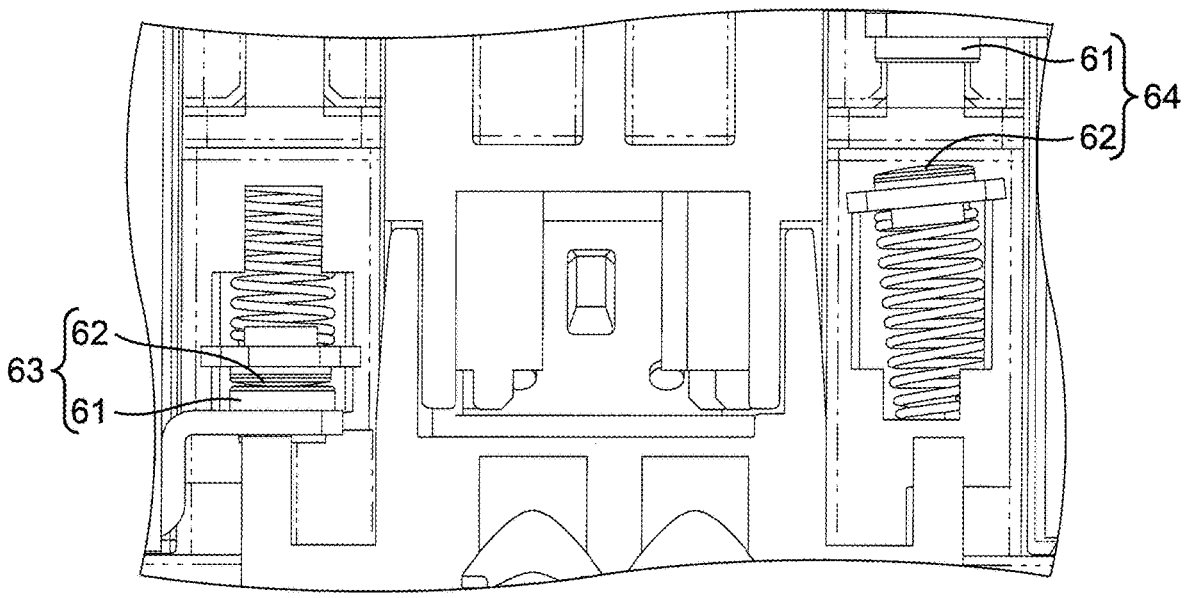
FIG. 22 is a first plan view for explaining the operation of the contact mechanism of the push-button switch of FIG. 1.
Figure 23:
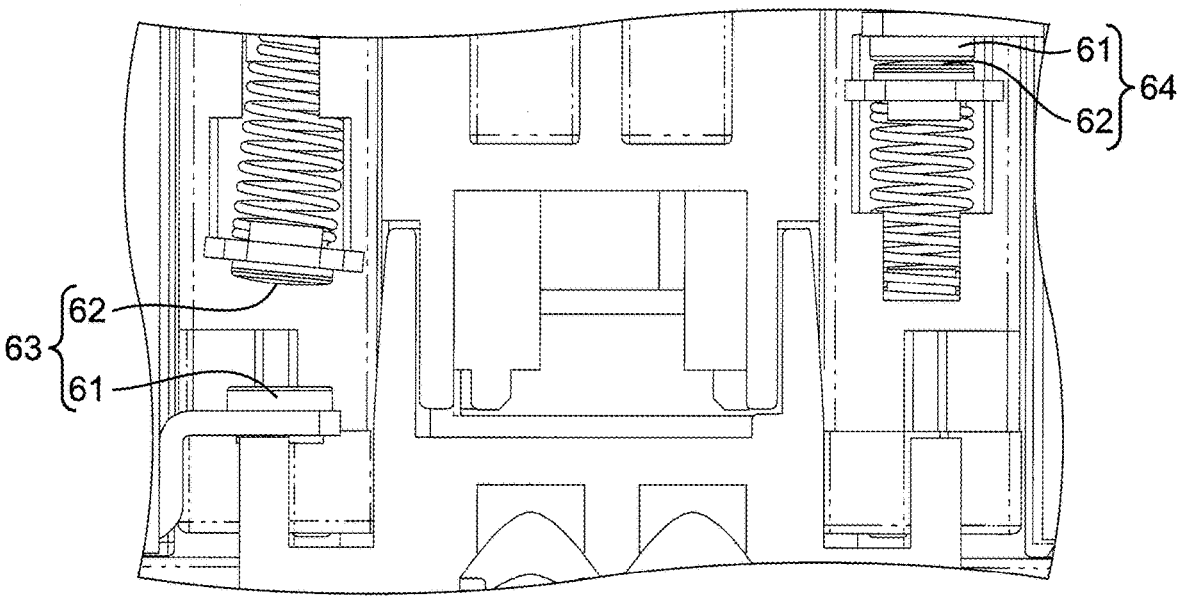
FIG. 23 is a second plan view for explaining the operation of the contact mechanism of the push-button switch of FIG. 1.

In more detail, the terminal connection mechanisms 16 are arranged in a line along the fulcrum forming surface 15 and the surface facing the fulcrum forming surface 15. The fixed contact portion 61 connected to the terminal connection mechanism 16 (hereinafter, referred to as a first terminal connection mechanism 161) disposed along the fulcrum forming surface 15 and the facing movable contact portion 62 constitute an NO contact 63, and the fixed contact portion 61 connected to the terminal connection mechanism 16 (hereinafter, referred to as a second terminal connection mechanism 162) disposed along the surface facing the fulcrum forming surface 15 and the facing movable contact portion 62 constitute an NC contact 64. That is, when the lever body 31 is at the first position P1, as shown in FIG. 22, the NO contact 63 is closed and the NC contact 64 is opened, while when the lever body 31 is at the second position P2, as shown in FIG. 23, the NO contact 63 is opened and the NC contact 64 is closed.

The biasing portion 70 has a coil spring 71 (shown in FIG. 13) as an example of a first biasing portion and a coil spring 72 (shown in FIG. 8) as an example of a second biasing portion.

As shown in FIG. 13, the coil springs 71 are respectively arranged in the recesses 413 provided at the four corners of the first plunger 41 inside the housing portion 11, and bias the plunger 40 from the operating position P4 along the movable direction toward the return position P3. Specifically, the respective coil springs 71 are arranged in a state in which they are sandwiched between a bottom surface of the recess 413 of the first plunger 41 and an inner surface 111 (see FIG. 24) constituting the housing portion 11 of the housing 10 facing the bottom surface, press the first plunger 41 in a direction away from the operation surface 12 along the movable direction, and bias the first plunger 41 from the operating position P41 toward the return position P31. That is, the respective coil springs 71 are arranged so that the pressing on the first plunger 41 is even and bias the lever body 31 of the lock lever unit 30 from the second position P2 toward the first position P1 via the first plunger 41.

As shown in FIG. 8, the coil spring 72 is disposed between the terminal connection surface 14 and the contact mechanism 60 along the movable direction inside the housing portion 11, and biases the plunger 40 along the movable direction from the return position P3 toward the operating position P4. More specifically, the coil spring 72 is disposed on a center line CL extending in the movable direction of the operation unit 20, and is disposed in a state in which it presses a portion of the contact mechanism 60 facing the terminal connection surface 14 toward the operation surface 12 and biases the second plunger 42 along the movable direction from the return position P32 toward the operating position P42 via the contact mechanism 60.

The coil spring 71 is configured so that the biasing force thereof is greater than the biasing force of the coil spring 72. As a result, as long as the lever body 31 is not operated, the plunger 40 is always positioned at the return position P3 and maintains a state in which the movable contact portion 62 of the NC contact 64 is separated from the fixed contact portion 61, and thus the safety of the push-button switch 1 is ensured.

Next, referring to FIG. 24, when the lever body 31 of the lock lever unit 30 is positioned at the second position P2, the operation of the push-button switch 1 when the operation unit 20 is pulled from the operation surface 12 toward the pressing surface 21 along the movable direction (that is, in the opening direction indicated by the arrow B in FIG. 24) will be described.

Figure 24:
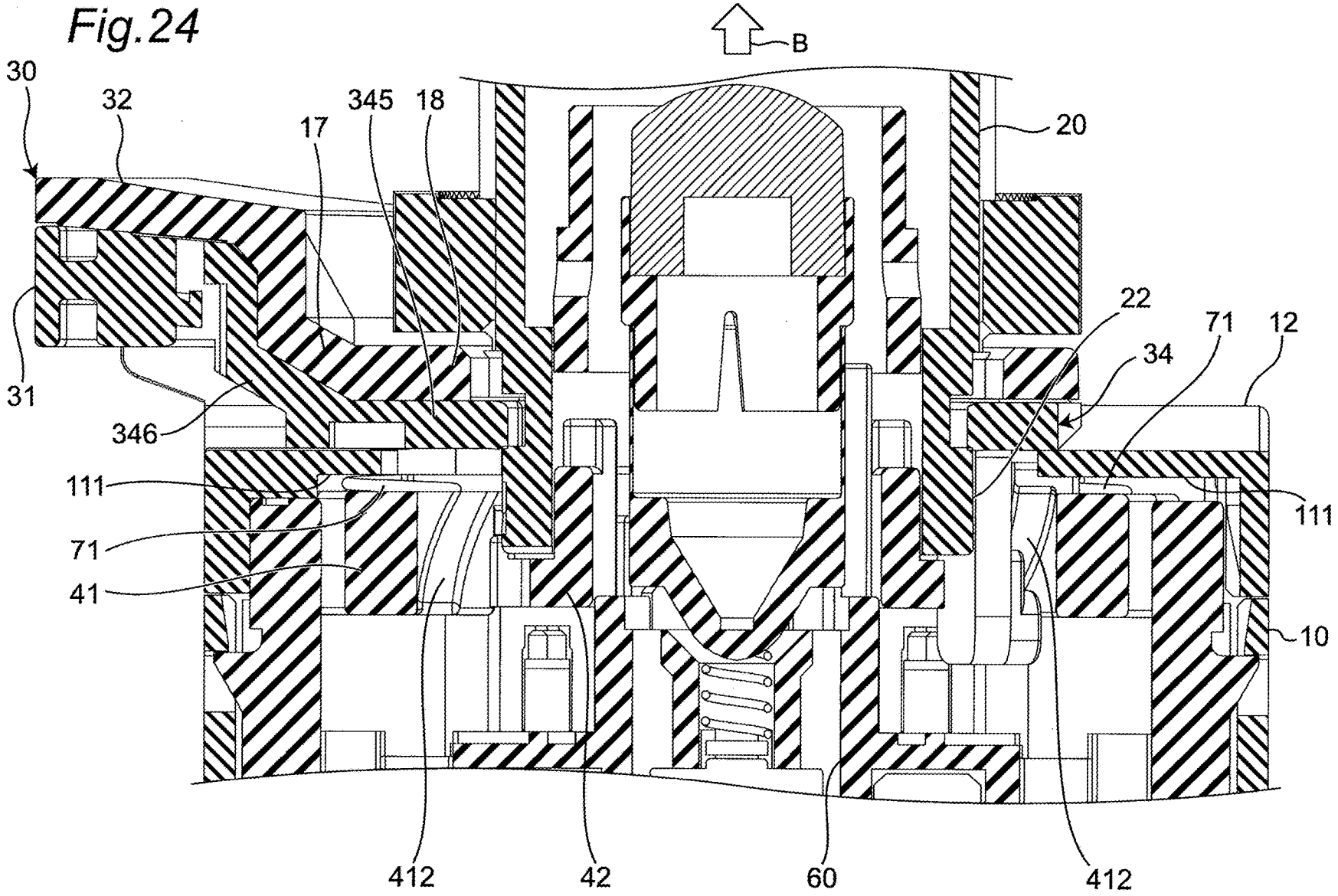
FIG. 24 is a sectional view taken along a line XXIV-XXIV in FIG. 1.

As shown in FIG. 24, a deformation portion 17 connected to the exterior portion 32 of the lock lever unit 30 and extending along the inclined portion 346 of the lever support portion 34 is provided on a wall 18 on the operation surface 12 side of the housing 10.

When the lever body 31 of the lock lever unit 30 is positioned at the second position P2, the end 22 of the operation unit 20 on the housing portion 11 side and the lever support portion 34 of the lock lever unit 30 are movably connected together in the movable direction. Therefore, when the operation unit 20 is pulled in the opening direction, the lever support portion 34 is also pulled together in the opening direction.

When the lever support portion 34 is pulled in the opening direction, the inclined portion 346 of the lever support portion 34 moves toward the operation unit 20 and comes into contact with the deformation portion 17 of the housing 10. The inclined portion 346 in contact with the deformation portion 17 is deformed in the approaching direction, moves the lever body 31 in the approaching direction, and releases the pressing to the lever body 31 by the holding unit 33. When the pressing to the lever body 31 by the holding unit 33 is released, the lever body 31 moves from the second position P2 to the first position P1 by the coil spring 71, and the movable contact portion 62 of the NC contact 64 is separated from the corresponding fixed contact portion 61.

Subsequently, the operation of the lever body 31 using the jig 100 will be described with reference to FIGS. 25 and 26.

Figure 25:
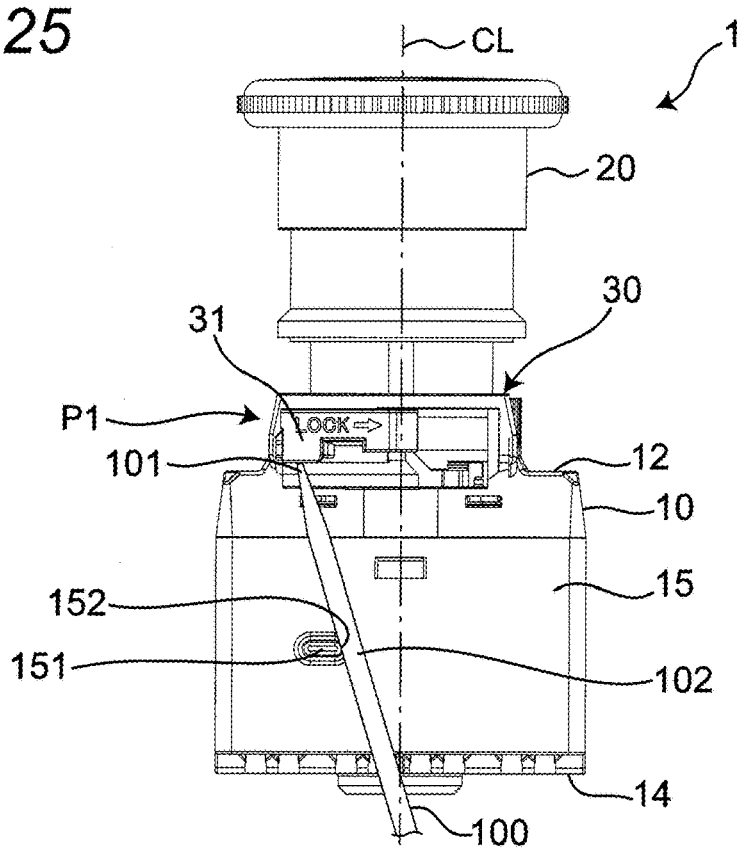
FIG. 25 is a first front view for explaining the operation of a lever body using a jig of the push-button switch of FIG. 1.
Figure 26:
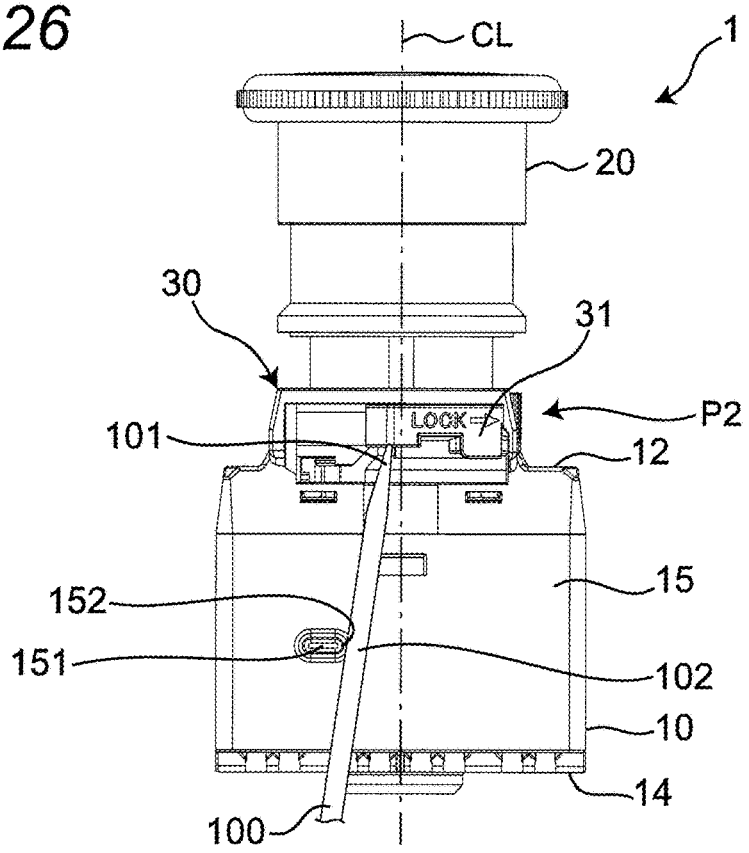
FIG. 26 is a second front view for explaining the operation of the lever body using the jig of the push-button switch of FIG. 1.

First, as shown in FIG. 25, the distal end 101 of the jig 100 is locked to the locking portion 312 of the lever body 31 at the first position P1. At this time, the jig 100 is disposed so that the intermediate portion 102 thereof contacts the curved surface 152 of the fulcrum projection 151.

Then, the jig 100 is rotated clockwise in FIG. 25 while the distal end 101 is locked to the locking portion 312 with the curved surface 152 of the fulcrum projection 151 contacting the intermediate portion 102 of the jig 100 as a rotation fulcrum. As a result, the lever body 31 moves from the first position P1 to the second position P2, as shown in FIG. 26.

As described above, in the push-button switch 1, it is possible to move the lever body 31 from the first position P1 to the second position P2 using the jig 100.

As described above, according to the push-button switch 1, the plunger 40 has the first plunger 41 that can move between the return position P3 and the operating position P4 by the transmission mechanism 50 of the lock lever unit 30, and the second plunger 42 that is disposed in series with respect to the first plunger 41 and disposed farther away from the operation surface 12 than the first plunger 41, and can move to the return position P3 by the operation unit 20. The first plunger 41 and the second plunger 42 can move independently of each other, and are configured so that the movable contact portion 62 contacts with or separates from the fixed contact portion 61 by the movement of the second plunger 42. That is, in the push-button switch 1, it is possible to ensure the contact reliability of the movable contact portion 62 with respect to the fixed contact portion 61 by merely ensuring the positional accuracy of the second plunger 42 and the contact mechanism 50 without being affected by the securement of the positional accuracy of the lock lever unit 30. For this reason, for example, the contact reliability of the fixed contact portion 61 and the movable contact portion 62 can be ensured more easily than that of the operation switch of PTL 1 in which the positional accuracy of the lock lever, the cam, the holder, and the contact B needs to be ensured.

Further, the first plunger 41 has the through hole 411 that penetrates in the movable direction and a plurality of cam grooves 412 which are provided on the inner circumferential surface 414 of the through hole 411 and arranged at an interval from each other in the circumferential direction of the inner circumferential surface 414, and which are respectively inclined so as to be away from the operation surface 12 along the moving direction of the lever body 31 from the first position P1 toward the second position P2, and the lock lever unit 30 has the lever support portion 34 which is disposed in the through hole 411 and extends along the inner circumferential surface 414 of the through hole 411 and a plurality of cam projections 343 which are provided so as to respectively correspond to the plurality of cam grooves 412 and which protrude from the outer circumferential surface 351 facing the inner circumferential surface 414 of the lever support portion 34 and respectively engage with the corresponding plurality of cam grooves 412. The transmission mechanism 50 includes a plurality of cam grooves 412, a lever support portion 34, and a plurality of cam projections 343. The transmission mechanism 50 can move the entire plunger 40 more reliably along the movable direction, so that the contact reliability of the fixed contact portion 61 and the movable contact portion 62 can be ensured.

According to the push-button switch 1, the lever body 31 of the lock lever unit 30 has the locking portion 312 that can lock the one end 101 of the long jig 100 in the extending direction thereof, and the housing 10 has a fulcrum projection 151 that contacts the intermediate portion 102 of the jig 100 in which one end 101 is locked to the locking portion 312 when the lever body 31 of the lock lever unit 30 is moved from the first position P1 to the second position P2 using the jig 100, and serves as a rotation fulcrum of the jig 100. Due to the locking portion 312 and the fulcrum projection 151, even when, for example, a large force is required for the rotation operation of the lever body 31 of the lock lever unit 30, the leverage principle is generated by using the jig 100, and the lever body 31 of the lock lever unit 30 can be easily rotated with a smaller force.

The holding unit 33 has an elastic holding portion 331 capable of holding the lever body 31 by pressing the lever body 31 from one side to the other side in the movable direction at the second position P2 and a hold releasing portion 313 capable of releasing the holding of the lever body 31 by the elastic holding portion 331 by pressing the lever body 31 from the other side to one side in the movable direction at the second position P2. With the elastic holding portion 331 and the hold releasing portion 313, the lever body 31 can be held at the second position P2, and the holding of the lever body 31 by the elastic holding portion 331 can be released with a simpler configuration.

Further, the lever body 31 has a protection wall 314 disposed on the opposite side of the fulcrum forming surface 15 with respect to the hold releasing portion 313 in the direction intersecting the fulcrum forming surface 15 and protecting the hold releasing portion 313 in the direction intersecting the fulcrum forming surface 15. The protection wall 314 can reduce erroneous operation of the hold releasing portion 313.

The fulcrum projection 151 has a curved surface 152 provided at a portion in contact with the intermediate portion 102 of the jig 100 and protruding from the fulcrum projection 151 toward the jig 100. Due to the curved surface 152, the rotation fulcrum of the jig 100 becomes constant, and the lever body 31 can be operated more easily by using the jig 100.

Further, the fulcrum projection 151 is disposed closer to the first position P1 than the center between the first position P1 and the second position P2 in the moving direction of the lever body 31 when viewed from a direction orthogonal to the fulcrum forming surface 15. Thus, the lever body 31 can be operated more easily by using the jig 100.

According to the push-button switch 1, the housing 10 has a deformation portion 17 that, when the operation unit 20 is pulled in the opening direction in which it is separated from the housing 10 when the lever body 31 is positioned at the second position P2, contacts the lever support portion 34 to move the lever body 31, and deforms the lever body 31 so as to be capable of releasing the pressing to the lever body 31 by the holding unit 33. Due to this deformation portion 17, when the lever body 31 is held by the holding unit 33 in a state in which the lever body 31 is at the second position P2 and the movable contact portion 62 is in contact with the fixed contact portion 61, even if the operation unit 20 is pulled in the opening direction in which it is separated from the housing 10, since the holding of the lever body 31 by the holding unit 33 can be released, and the movable contact portion 62 can be separated from the fixed contact portion 61, it is possible to realize the push-button switch 1 capable of easily ensuring safety.

Further, the lever body 31 is disposed between the pressing surface 21 and the operation surface 12 in the movable direction, and the lever support portion 34 has the lever connection portion 345 that extends along the operation surface 12 and is connected to the operation unit 20 so as to be movable in the movable direction together with the operation unit 20 when the lever body 31 is at the second position P2, and the inclined portion 346 that is connected to the lever connection portion 345 and the lever body 31 and is inclined in the opening direction from the lever connection portion 345 toward the lever body 31. In addition, the deformation portion 17 is disposed facing the inclined portion 346 and capable of contacting the inclined portion 346, and when the operation unit 20 is pulled in the opening direction, the deformation portion 17 contacts the inclined portion 346 to move the lever body 31 in the approaching direction and deforms the lever body 31 so as to be capable of releasing the pressing to the lever body 31 by the holding unit 33. Accordingly, when the lever body 31 is held by the holding unit 33 in a state in which the lever body 31 is at the second position P2 and the movable contact portion 62 is in contact with the fixed contact portion 61, even if the operation unit 20 is pulled in the opening direction in which it is separated from the housing 10, the holding of the lever body 31 by the holding unit 33 can be released more reliably, and the movable contact portion 62 can be separated from the fixed contact portion 61.

According to the push-button switch 1, it includes a lock lever unit 30 having a lever body 31 movable between a first position P1 and a second position P2 and a holding unit 33 capable of holding the lever body 31 at the second position P2, a transmission mechanism 50 that moves the plunger 40 from the return position P3 to the operating position P4 as the lever body 31 moves from the first position P1 toward the second position P2, but moves the plunger 40 from the operating position P4 to the return position P3 as the lever body 31 moves from the second position P2 toward the first position P1, a movement regulating portion 80 that, when the lever body 31 is positioned at the first position P1, enables movement of the lever body 31 to the second position P2 when the end 22 of the operation unit 20 on the housing portion 11 side is positioned at an initial position, but disables movement of the lever body 31 to the second position P2 when the end 22 of the operation unit 20 on the housing portion 11 side is positioned closer to the operation surface 12 than the initial position, and a coil spring 71 that biases the plunger 40 from the operating position P4 toward the return position P3. That is, in the push-button switch 1, for example, when the operation unit 20 once removed for maintenance or the like is attached to the housing 10, when the end 22 of the operation unit 20 on the housing portion 11 side is positioned at the initial position, the lever body 31 can be moved to the second position P2 and held by the holding unit 33, but when the end 22 of the operation unit 20 on the housing portion 11 side is positioned closer to the operation surface 12 than the initial position in the movable direction, the lever body 31 cannot be moved to the second position P2, and the lever body 31 is biased by the first biasing portion 71 via the plunger 40 to move to the first position P1. This makes it possible to realize a push-button switch 1 to which the operation unit 20 can be reliably attached in a complete state.

Further, a coil spring 72 that is provided inside the housing portion 11 and biases the plunger 40 from the return position P3 toward the operating position P4 along the movable direction is further provided, and is configured so that the biasing force of the coil spring 71 is greater than the biasing force of the coil spring 72. The plunger 40 has a first plunger 41 that is disposed so as to be able to be biased by the coil spring 71, and is movable along the movable direction between the return position P31 and the operating position P41 by the transmission mechanism 50 as the lever body 31 moves between the first position P1 and the second position P2, and a second plunger 42 that is disposed farther away from the operation surface 12 along the movable direction than the first plunger 41 in a state capable of being biased by the coil spring 72 and disposed in series with the first plunger 41 along the movable direction, and is positioned at the return position P32 by the approaching operation of the operation unit 20. Further, the first plunger 41 and the second plunger 42 can move independently of each other along the movable direction, and are configured so that the movable contact portion 62 contacts with or separates from the fixed contact portion 61 by the movement of the second plunger 42 along the movable direction. This makes it possible to ensure the contact reliability of the movable contact portion 62 with respect to the fixed contact portion 61 by merely ensuring the positional accuracy of the second plunger 42 and the contact mechanism 50 without being affected by the securement of the positional accuracy of the lock lever unit 30.

Further, the first plunger 41 has a through hole 411 that penetrates in the movable direction and a plurality of cam grooves 412 which are provided on the inner circumferential surface 414 of the through hole 411 and are arranged at an interval from each other in the circumferential direction of the inner circumferential surface 414 and which are respectively inclined away from the operation surface 12 along the moving direction of the lever body 31 from the first position P1 toward the second position P2, and the lever support portion 34 has a plurality of cam projections 343 which are arranged in the through hole 411 and extend along the inner circumferential surface 414 of the through hole 411 and which are provided so as to respectively correspond to the plurality of cam grooves 412, protrude from the outer circumferential surface 351 facing the inner circumferential surface 414 of the lever support portion 34 toward the inner circumferential surface 414, and respectively engage with the corresponding plurality of cam grooves 412. The transmission mechanism 50 includes a plurality of cam grooves 412, a lever support portion 34, and a plurality of cam projections 343. The transmission mechanism 50 can move the entire plunger 40 more reliably along the movable direction, so that the contact reliability of the fixed contact portion 61 and the movable contact portion 62 can be ensured.

Further, the lever support portion 34 surrounds the end 22 of the operation unit 20 on the housing portion 11 side in the circumferential direction (that is, around the movable direction), has an inner circumferential surface 341 disposed so as to face the end 22 of the operation unit 20 on the housing portion 11 side, and has a locking projection 342 protruding from the inner circumferential surface 341 toward the operation unit 20, and the end 22 of the operation unit 20 on the housing portion 11 side has a first groove 23 extending in the movable direction and capable of housing the locking projection 342 when the lever body 31 is at the first position P1 and a second groove 24 which is connected to the end 231 of the first groove 23 on the pressing surface 21 side in the movable direction and extends along the circumferential direction of the end 22 of the operation unit 20 on the housing portion 11 side so as to be capable of housing the locking projection 342 and which locks the locking projection 342 in the movable direction when the lever body 31 is at the second position P2. The movement regulating portion 80 includes the locking projection 342, the first groove 23, and the second groove 24. Accordingly, the movement of the lever body 31 to the second position can be regulated with a simple configuration, so that it is possible to easily realize the push-button switch 1 to which the operation unit 20 can be reliably attached in a complete state.

Further, the first biasing portion is configured by a plurality of coil springs 71. Thus, with a simple configuration, the plunger 40 can be biased from the operating position P4 toward the return position P3 along the movable direction.

Further, the second biasing portion is configured by at least one coil spring 72. Thereby, with a simple configuration, the plunger 40 can be biased from the return position P3 toward the operating position P4 along the movable direction.

Note that, the configuration other than the housing 10, the operation unit 20, the lock lever unit 30, and the first biasing portion 71 may be omitted if possible, or may be replaced with a configuration different from the push-button switch 1. For example, the fulcrum projection 151 of the housing 10 may be omitted.

The transmission mechanism 50 is not limited to the case where it includes the lever support portion 34, the plurality of cam projections 343, and the plurality of cam grooves 412. The transmission mechanism 50 can adopt any configuration that can move the plunger 40 from the return position P3 to the operating position P4 as the lever body 31 moves from the first position P1 toward the second position P2, but can move the plunger 40 from the operating position P4 to the return position P3 as the lever body 31 moves from the second position P2 toward the first position P1.

The contact mechanism 60 can adopt a contact mechanism with any configuration as long as it includes a fixed contact portion 61 and a movable contact portion 62 that is provided so as to face the fixed contact portion 61 in the movable direction, contacts the fixed contact portion 61 when the plunger 40 moves from the return position P3 to the operating position P4, and separates from the fixed contact portion 61 when the plunger 40 moves from the operating position P4 to the return position P3.

The lever connection portion 345 of the lever support portion 34 is not limited to a substantially annular shape, and may be, for example, a semi-circular shape.

The holding unit 33 is not limited to the case where it is configured by the elastic holding portion 331, and any configuration can be adopted as long as the lever body 31 can be held at the second position P2. Further, the hold releasing portion 313 can be appropriately changed according to the configuration of the holding unit 33.

The protection wall 314 is not limited to the case where it is provided on the lever body 31, but may be provided on the exterior portion 32, for example.

Figure 27:
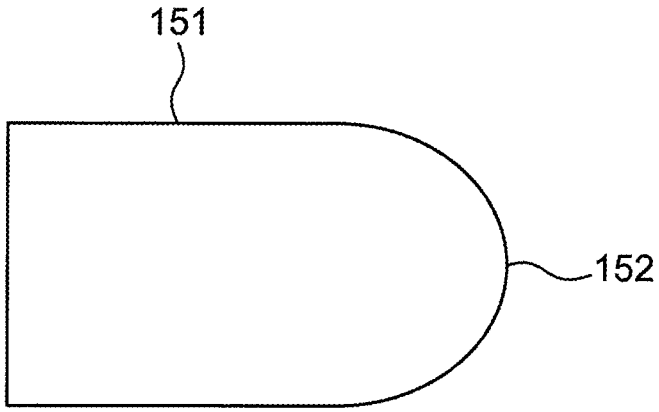
FIG. 27 is a view for explaining a first modification of a fulcrum projection of the push-button switch of FIG. 1.
Figure 28:
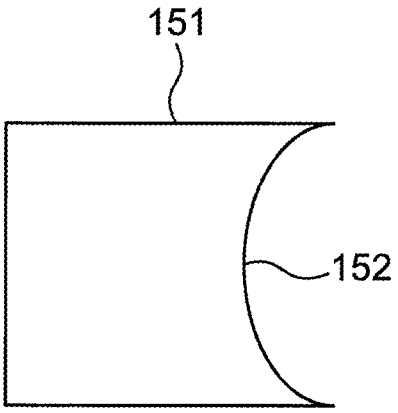
FIG. 28 is a view for explaining a second modification of the fulcrum projection of the push-button switch of FIG. 1.
Figure 29:
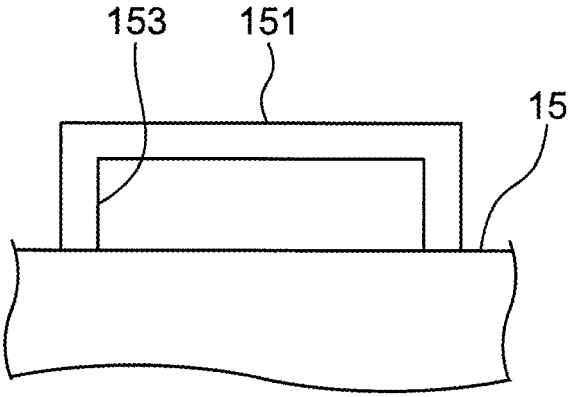
FIG. 29 is a view for explaining a third modification of the fulcrum projection of the push-button switch of FIG. 1.

The fulcrum projection 151 is not limited to a case having an oval shape. For example, as shown in FIG. 27, it may be a fulcrum projection 151 having a curved surface 152 only on a side in contact with the intermediate portion 102 of the jig 100 in its extending direction when viewed from a direction orthogonal to the fulcrum forming surface 15. Further, as shown in FIG. 28, it may be a fulcrum projection 151 having a curved surface 152 protruding in a direction away from the jig 100 on a side in contact with the intermediate portion 102 of the jig 100 in its extending direction when viewed from a direction orthogonal to the fulcrum forming surface 15. Further, as shown in FIG. 29, it may be a fulcrum projection 151 having a through hole 153 penetrating in the movable direction. In this case, the inner circumferential surface of the through hole 153 contacts the intermediate portion 102 of the jig 100 and serves as a rotation fulcrum of the jig 100.

The first biasing portion is not limited to a case where it is configured by a plurality of coil springs 71, and can adopt a biasing portion with any configuration capable of biasing the plunger 40 from the operating position P4 toward the return position P3 along the movable direction. For example, the first biasing portion may be configured by a single or three or more coil springs 71.

The second biasing portion is not limited to a case where it is configured by a single coil spring 72, and can adopt a biasing portion with any configuration capable of biasing the plunger 40 from the return position P3 toward the operating position P4 along the movable direction. For example, the second biasing portion may be configured by a plurality of coil springs 72.

It is sufficient that the plunger 40 has a first plunger 41 and a second plunger 42 and is movable between the return position P3 and the operating position P4 along the movable direction, and its shape and the like can be changed as appropriate by the design and the like of the push-button switch 1.

It is sufficient that the deformation portion 17 is configured such that when the operation unit 20 is pulled in the opening direction in which the operation unit 20 is separated from the housing 10 while the lever body 31 is positioned at the second position P2, the deformation portion 17 contacts the lever support portion 34 to move the lever body 31, and deforms the lever body 31 so as to be capable of releasing the pressing to the lever body 31 by the holding unit 33. That is, the shape and the like of the deformation portion 17 can be appropriately changed according to the shape and the like of the lever body 31 and the lever support portion 34.

The movement regulating portion 80 is not limited to the case where it includes the locking projection 342, the first groove 23, and the second groove 24. The movement regulating portion 80 can adopt any configuration that, when the lever body 31 is positioned at the first position P1, enables the movement of the lever body 31 to the second position P2 when the end 22 of the operation unit 20 on the housing portion 11 side is positioned at the initial position, but disables the movement of the lever body 31 to the second position P2 when the end 22 of the operation unit 20 on the housing portion 11 side is positioned closer to the operation surface 12 than the initial position.

As described above, various embodiments of the present disclosure have been described in detail with reference to the drawings, and finally, various aspects of the present disclosure will be described. In the following description, description will be provided with reference numerals attached thereto as an example.

The push-button switch 1 according to the first aspect of the present disclosure includes:

a housing 10 having an operation surface 12 provided with an operation hole 13 and a housing portion 11 provided therein and connected to the operation hole 13;

an operation unit 20 that extends along a movable direction intersecting the operation surface 12 from an outside of the housing 10 through the operation hole 13 to an inside of the housing portion 11 and has a pressing surface 21 provided at the outside of the housing 10 and disposed so as to face the operation surface 12, the pressing surface 21 being capable of approaching the operation surface 12 along the movable direction;

a lock lever unit 30 that has a lever body 31 provided at an end portion of the housing 10 on the operation surface 12 side and movable in a direction intersecting the movable direction between a first position P1 and a second position P2, a lever support portion 34 provided in the inside of the housing portion 11 and connected to the lever body 31 so as to be movable together with the lever body 31, and a holding unit 33 capable of holding the lever body 31 by pressing the lever body 31 at the second position P2 from an approaching direction of the pressing surface 21 to the operation surface 12, and a biasing portion 71 provided inside the housing portion 11 and biasing the lever body 31 from the second position P2 toward the first position P1, in which the lever support portion 34 is connected to the operation unit 20 so as to be movable in the movable direction together with the operation unit 20 when the lever body 31 is positioned at the second position P2, and the housing 10 has a deformation portion 17 that, when the operation unit 20 is pulled from the operation surface 12 toward the pressing surface 21 along the movable direction when the lever body 31 is positioned at the second position P2, contacts the lever support portion 34 to move the lever body 31 in the approaching direction, and deforms the lever body 31 so as to be capable of releasing the pressing to the lever body 31 by the holding unit 33.

According to the push-button switch 1 of the first aspect, when the lever body 31 is held by the holding unit 33 in a state where the lever body 31 is positioned at the second position P2 and the movable contact portion 62 is in contact with the fixed contact portion 61, even if the operation unit 20 is pulled in the opening direction in which the operation unit 20 is separated from the housing 10, since the deformation portion 17 can release the holding of the lever body 31 by the holding unit 33 and separate the movable contact portion 62 from the fixed contact portion 61, it is possible to realize the push-button switch 1 capable of easily ensuring safety.

The push-button switch 1 according to the second aspect of the present disclosure includes:

the lever body 31 disposed between the pressing surface 21 and the operation surface 12 in the movable direction;

the lever support portion 34 having a connection portion extending along the operation surface 12 and connected to the operation unit 20 so as to be movable in the movable direction together with the operation unit 20 when the lever body 31 is at the second position P2;

an inclined portion 346 connected to the connection portion 345 and the lever body 31 and inclined in the opening direction from the connection portion 345 toward the lever body 31; and the deformation portion 17 that is disposed so as to face the inclined portion 346 and to be capable of contacting the inclined portion 346, and when the operation unit 20 is pulled in the opening direction, contacts the inclined portion 346 to move the lever body 31 in the approaching direction, and deforms the lever body 31 so as to be capable of releasing the pressing to the lever body 31 by the holding unit 33.

According to the push-button switch 1 of the second aspect, when the lever body 31 is held by the holding unit 33 in a state where the lever body 31 is at the second position P2 and the movable contact portion 62 is in contact with the fixed contact portion 61, even if the operation unit 20 is pulled in the opening direction in which the operation unit 20 is separated from the housing 10, the holding of the lever body 31 by the holding unit 33 can be more reliably released, and the movable contact portion 62 can be separated from the fixed contact portion 61.

In the push-button switch 1 according to the third aspect of the present disclosure, the biasing portion is configured by a plurality of coil springs 71.

According to the push-button switch 1 of the third aspect, the plunger 40 can be biased from the operating position P4 toward the return position P3 along the movable direction with a simple configuration.

In addition, by appropriately combining any of the above-described various embodiments or modifications, the effects of the respective embodiments or modifications can be achieved. In addition, a combination of the embodiments or a combination of the examples or a combination of the embodiment and the example is possible, and a combination of the features in the different embodiments or the examples is also possible.

Although the present disclosure has been fully described in connection with preferred embodiments with reference to the accompanying drawings, various variations and modifications will be apparent to those skilled in the art. It is to be understood that such variations and modifications are included therein unless they depart from the scope of the present disclosure as set forth in the appended claims.

INDUSTRIAL APPLICABILITY

The push-button switch of the present disclosure can be applied to, for example, an emergency stop switch.

REFERENCE SIGNS LIST

1. push-button switch
10. housing
11. housing portion
12. operation surface
13. operation hole
14. terminal connection surface
141. opening
15. fulcrum forming surface
151. fulcrum projection
152. curved surface
16. terminal connection mechanism
161. first terminal connection mechanism
162. second terminal connection mechanism
17. deformation portion
18. wall
20. operation unit
21. pressing surface
22. end
23. first groove
231. end
24. second groove
25, 26. display portion
30. lock lever unit
301. lever portion
31. lever body
311. facing surface
312. locking portion
313. hold releasing portion
314. protection wall
32. exterior portion
321. first wall portion
322. second wall portion
323. third wall portion
33. holding unit
331. elastic holding portion
332, 333. end
34. lever support portion
341. inner circumferential surface
342. locking projection
343. cam projection
344. through hole
345. lever connection portion
346. inclined portion
35. leg
351. outer circumferential surface
36, 37. display portion
40. plunger
41. first plunger
411. through hole
412. cam groove
413. recess
414. inner circumferential surface
42. second plunger
421. main body
422. plunger connection portion
423. through hole
424. annular wall
50. transmission mechanism
60. contact mechanism
61. fixed contact portion
62. movable contact portion
63. NO contact
64. NC contact
70. biasing portion
71, 72. coil spring
80. movement regulating portion
90. LED unit
100. jig
101. distal end
102. intermediate portion
P1. first position
P2. second position
P3, P31, P32. return position
P4, P41, P42. operating position
A, B. arrow
CP. center
CL. center line

The invention claimed is:

1. A push-button switch comprising:

a housing having an operation surface provided with an operation hole and a housing portion provided therein and connected to the operation hole;

an operation unit that extends along a movable direction intersecting the operation surface from an outside of the housing through the operation hole to an inside of the housing portion and has a pressing surface provided at the outside of the housing and disposed so as to face the operation surface, the pressing surface being capable of approaching the operation surface along the movable direction;

a lock lever unit that has a lever body provided at an end portion of the housing on the operation surface side and movable in a direction intersecting the movable direction between a first position and a second position, a lever support portion provided in the inside of the housing portion and connected to the lever body so as to be movable together with the lever body, and a holding unit capable of holding the lever body by pressing the lever body at the second position from an approaching direction of the pressing surface to the operation surface; and a biasing portion provided inside the housing portion and biasing the lever body from the second position toward the first position, wherein the lever support portion is connected to the operation unit so as to be movable in the movable direction together with the operation unit when the lever body is positioned at the second position, and the housing has a deformation portion that, when the operation unit is pulled from the operation surface toward the pressing surface along the movable direction when the lever body is positioned at the second position, contacts the lever support portion to move the lever body in the approaching direction, and deforms the lever body so as to be capable of releasing the pressing to the lever body by the holding unit.

2. The push-button switch according to claim 1, wherein the lever body is disposed between the pressing surface and the operation surface in the movable direction, the lever support portion includes a connection portion extending along the operation surface and connected to the operation unit so as to be movable in the movable direction together with the operation unit when the lever body is at the second position; and an inclined portion connected to the connection portion and the lever body and inclined in the opening direction from the connection portion toward the lever body, and the deformation portion is disposed so as to face the inclined portion and to be capable of contacting the inclined portion, and when the operation unit is pulled in the opening direction, contacts the inclined portion to move the lever body in the approaching direction, and deforms the lever body so as to be capable of releasing the pressing to the lever body by the holding unit.

3. The push-button switch according to claim 1, wherein the biasing portion is configured by a plurality of coil springs.

4. The push-button switch according to claim 2, wherein the biasing portion is configured by a plurality of coil springs.

* * * * *